US012742230B2

(12) United States Patent
Yang et al.

(10) Patent No.: US 12,742,230 B2
(45) Date of Patent: Sep. 22, 2026

(54) MULTI-COMPONENT HIGH ENTROPY ALLOY WITH NANOSCALE ATOMIC SELF-ORDERING STRUCTURE AND PREPARATION METHODS THEREOF

(71) Applicant: City University of Hong Kong, Hong Kong (HK)

(72) Inventors: Tao Yang, Hong Kong (HK); Jiang Ju, Hong Kong (HK)

(73) Assignee: City University of Hong Kong, Hong Kong (HK)

( * ) Notice: Subject to any disclaimer, the term of this patent is extended or adjusted under 35 U.S.C. 154(b) by 372 days.

(21) Appl. No.: 18/616,224

(22) Filed: Mar. 26, 2024

(65) Prior Publication Data

US 2024/0344183 A1 Oct. 17, 2024

Related U.S. Application Data

(60) Provisional application No. 63/496,413, filed on Apr. 16, 2023.

(51) Int. Cl.

| | |
|---|---|
| ***C22C 30/00*** | (2006.01) |
| ***B22F 9/10*** | (2006.01) |
| ***B22F 10/28*** | (2021.01) |
| ***C22C 1/04*** | (2023.01) |

(52) U.S. Cl.

CPC ..... *C22C 30/00* (2013.01); *B22F 9/10* (2013.01); *B22F 10/28* (2021.01); *C22C 1/04* (2013.01)

(58) Field of Classification Search

None

See application file for complete search history.

(56) References Cited

FOREIGN PATENT DOCUMENTS

| | | | | | |
|---|---|---|---|---|---|
| CN | 107557645 | A | * | 1/2018 | |
| CN | 111168057 | A | * | 5/2020 | ..... B22F 1/065 |
| CN | 113215468 | A | * | 8/2021 | ..... B33Y 70/00 |
| CN | 114875371 | A | * | 8/2022 | ..... C22C 30/02 |
| CN | 115305388 | A | * | 11/2022 | ..... C22C 1/0433 |

OTHER PUBLICATIONS

Thanhung Nguyen et al., Microstructure and tensile properties of duplex phase Al0.25FeMnNiCrCu0.5 high entropy alloy fabricated by laser melting deposition, Journal of Alloys and Compounds, 2021, vol. 871, No. 159521, p. 1-8.

Jie Ren et al., Strong yet ductile nanolamellar high-entropy alloys by additive manufacturing, Nature, 2022, vol. 608, p. 62-68.

(Continued)

*Primary Examiner* — Jenny R Wu

(74) *Attorney, Agent, or Firm* — Idea Intellectual Limited; Sam T. Yip

(57) ABSTRACT

The present invention uses additive manufacturing technology to develop a new $L1_2$ reinforced multi-component high entropy alloy, which has high density and excellent strength and ductility mechanical properties. The selective laser melting process employed in crafting these multi-component high entropy alloys renders them safer, more cost-effective, and significantly reduces processing time, thus positioning them as highly competitive offerings within the market.

16 Claims, 29 Drawing Sheets

(56) References Cited

OTHER PUBLICATIONS

Qingkai Shen et al., Significant transitions of microstructure and mechanical properties in additively manufactured Al—Co—Cr—Fe—Ni high-entropy alloy under heat treatment, Materials Science & Engineering A, 2021, vol. 815, No. 141257, p. 1-9.
Saket ThapliyaL et al., Segregation engineering of grain boundaries of a metastable Fe—Mn—Co—Cr—Si high entropy alloy with laser-powder bed fusion additive manufacturing, Acta Materialia, 2021, vol. 219, No. 117271, p. 1-16.
Haili Yao et al., High strength and ductility AlCrFeNiV high entropy alloy with hierarchically heterogeneous microstructure prepared by selective laser melting, Journal of Alloys and Compounds, 2020, vol. 813, No. 152196, p. 1-8.
Z. G. Zhu et al., Selective laser melting enabling the hierarchically heterogeneous microstructure and excellent mechanical properties in an interstitial solute strengthened high entropy alloy, Materials Research Letters, 2019, vol. 7, No. 11, p. 453-459.
Giulio Marchese et al., Influence of heat treatments on microstructure evolution and mechanical properties of Inconel 625 processed by laser powder bed fusion, Materials Science & Engineering A, 2018, vol. 729, p. 64-75.
Fei Weng et al., Excellent combination of strength and ductility of CoCrNi medium entropy alloy fabricated by laser aided additive manufacturing, Additive Manufacturing, 2020, vol. 34, No. 101202, p. 1-8.
Philipp Kürnsteiner et al., High-strength Damascus steel by additive manufacturing, Nature, 2020, vol. 582, p. 515-519.
B. Gwalani et al., Cu assisted stabilization and nucleation of L12 precipitates in Al0.3CuFeCrNi2 fcc-based high entropy alloy, Acta Materialia, 2017, vol. 129, p. 170-182.
Bo Li et al., Fine-structured CoCrFeNiMn high-entropy alloy matrix composite with 12 wt% TiN particle reinforcements via selective laser melting assisted additive manufacturing, Materials Letters, 2019, vol. 252, p. 88-91.
Danyang Lin et al., A Si-containing FeCoCrNi high-entropy alloy with high strength and ductility synthesized in situ via selective laser melting, Additive Manufacturing, 2020, vol. 35, No. 101340, p. 1-13.
Jeong Min Park et al., Superior tensile properties of 1%C-CoCrFeMnNi high-entropy alloy additively manufactured by selective laser melting, Materials Research Letters, 2020, vol. 8, No. 1, p. 1-7.
Jeong Min Park et al., Effect of heat treatment on microstructural heterogeneity and mechanical properties of 1%C—CoCrFeMnNi alloy fabricated by selective laser melting, Additive Manufacturing, 2021, vol. 47, No. 102283, p. 1-13.
Aref Yadollahi et al., Effects of building orientation and heat treatment on fatigue behavior of selective laser melted 17-4 PH stainless steel, International Journal of Fatigue, 2017, vol. 94, p. 218-235.
Liang Zong et al., Low cycle fatigue behaviour of wire arc additively manufactured ER70S-6 steel, International Journal of Fatigue, 2023, vol. 176, No. 107910, p. 1-11.
Jaydeep Vishwakarma et al., Low cycle fatigue behaviour of additive manufactured maraging steel: Influence of build orientation and heat treatment, Materials Letters, 2023, vol. 350, No. 134943, p. 1-4.
Y. Xue et al., Microporosity effects on cyclic plasticity and fatigue of LENS™-processed steel, Acta Materialia, 2010, vol. 58, p. 4029-4038.
Shuxin Shen et al., Investigation on microstructure evolution of hybrid manufactured TC17 titanium alloy during cyclic deformation, Materials Science & Engineering A, 2023, vol. 886, No. 145469, p. 1-11.
Sindo Kou, A criterion for cracking during solidification, Acta Materialia, 2015, vol. 88, p. 366-374.
Lei Fan et al., Ultrahigh strength and ductility in newly developed materials with coherent nanolamellar architectures, Nature Communications, 2020, vol. 11, No. 6240, p. 1-8.
Suihe Jiang et al., Ultrastrong steel via minimal lattice misfit and high-density nanoprecipitation, Nature, 2017, vol. 544, p. 460-464.
Tong Li et al., Ultra-strong tungsten refractory high-entropy alloy via stepwise controllable coherent nanoprecipitations. Nature Communications, 2023, vol. 14, No. 3006, p. 1-7.
Madyslav Turlo et al., Grain boundary complexions and the strength of nanocrystalline metals: Dislocation emission and propagation, Acta Materialia, 2018, vol. 151, p. 100-111.
J. P. Hirth et al., Theory of Dislocations (2nd ed.), Journal of Applied Mechanics, 1983, vol. 50, p. 476-477.
Je Doo Yoo et al., Microband-induced plasticity in a high Mn—Al—C light steel, Materials Science and Engineering A, 2008, vol. 496, p. 417-424.
T. Yang et al., Ultrahigh-strength and ductile superlattice alloys with nanoscale disordered interfaces, Science, 2020, vol. 369, p. 427-432.
B. B. He et al., High dislocation density-induced large ductility in deformed and partitioned steels, Science, 2017, vol. 357, p. 1029-1032.
Xiqian Wang et al., Microstructure and yield strength of SLM-fabricated CM247LC Ni-Superalloy, Acta Materialia, 2017, vol. 128, p. 87-95.
Shuncun Luo et al., Selective laser melting of dual phase AlCrCuFeNix high entropy alloys: Formability, heterogeneous microstructures and deformation mechanisms, Additive Manufacturing, 2020, vol. 31, No. 100925, p. 1-10.
Tadashi Fujieda et al., Mechanical and corrosion properties of CoCrFeNiTi-based high-entropy alloy additive manufactured using selective laser melting, Additive Manufacturing, 2019, vol. 25, p. 412-420.
D. Ivanov et al., Evolution of structure and properties of the nickel-based alloy EP718 after the SLM growth and after different types of heat and mechanical treatment, Additive Manufacturing, 2017, vol. 18, p. 269-275.
Tresa M. Pollock, Alloy design for aircraft engines, Nature Materials, 2016, vol. 15, p. 809-815.
Chengyi Dan et al., Achieving ultrahigh fatigue resistance in AlSi10Mg alloy by additive manufacturing, Nature Materials, 2023, vol. 22, p. 1182-1188.
Jaime Bonnín Roca et al., Policy needed for additive manufacturing, Nature Materials, 2016, vol. 15, p. 815-818.
Dongdong Gu et al., Material-structure-performance integrated laser-metal additive manufacturing, Science, 2021, vol. 372, No. 1487, p. 1-15.
Y. Morris Wang et al., Additively manufactured hierarchical stainless steels with high strength and ductility, Nature Materials, 2018, vol. 17, p. 63-71.
Dirk Herzog et al., Additive manufacturing of metals, Acta Materialia, 2016, vol. 117, p. 371-392.
Tianlong Zhang et al., In situ design of advanced titanium alloy with concentration modulations by additive manufacturing, Science, 2021, vol. 374, p. 478-482.
S.S. Xu et al., Nanoscale precipitation and its influence on strengthening mechanisms in an ultra-high strength low-carbon steel, International Journal of Plasticity, 2019, vol. 113, p. 99-110.
Chuan Guo et al., Additive manufacturing of Ni-based superalloys: Residual stress, mechanisms of crack formation and strategies for crack inhibition, Nano Materials Science, 2023, vol. 5, p. 53-77.
Amir Mostafaei et al., Additive Manufacturing of Nickel-based superalloys: a state-of-the-art review on process-structure-defect-property relationship, Progress in Materials Science, 2023, vol. 136, No. 101108, p. 1-107.
Beth E. Carroll et al., Anisotropic tensile behavior of Ti—6Al—4V components fabricated with directed energy deposition additive manufacturing, Acta Materialia, 2015, vol. 87, p. 309-320.
Y. Kok et al., Anisotropy and heterogeneity of microstructure and mechanical properties in metal additive manufacturing: A critical review, Materials and Design, 2018, vol. 139, p. 565-586.

(56) References Cited

OTHER PUBLICATIONS

Yuman Zhu et al., Ultrastrong nanotwinned titanium alloys through additive manufacturing, Nature Materials, 2022, vol. 21, p. 1258-1262.
Ross Cunningham et al., Keyhole threshold and morphology in laser melting revealed by ultrahigh-speed x-ray imaging, Science, 2019, vol. 363, p. 849-852.
L.G. Sun et al., Nanostructural metallic materials: Structures and mechanical properties, Materials Today, 2020, vol. 38, p. 114-135.
Zhongpeng Zheng et al., Microstructure and anisotropic mechanical properties of selective laser melted Ti6Al4V alloy under different scanning strategies, Materials Science & Engineering A, 2022, vol. 831, No. 142236, p. 1-19.
Kun Chang et al., Microstructural feature and mechanical property in different building directions of additive manufactured Ti6Al4V alloy, Materials Letters, 2020, vol. 267, No. 127516, p. 1-5.
Kun Chang et al., On the texture and mechanical property anisotropy of Ti6Al4V alloy fabricated by powder-bed based laser additive manufacturing, Vacuum, 2020, vol. 181, No. 109732, p. 1-5.
Z.H. Xiong et al., Role of melt pool boundary condition in determining the mechanical properties of selective laser melting AlSi10Mg alloy, Materials Science & Engineering A, 2019, vol. 740-741, p. 148-156.
Noriko Read et al., Selective laser melting of AlSi10Mg alloy: Process optimisation and mechanical properties development, Materials and Design, 2015, vol. 65, p. 417-424.
U. Patakham et al., MPB characteristics and Si morphologies on mechanical properties and fracture behavior of SLM AISi10Mg, Materials Science & Engineering A, 2021, vol. 821, No. 141602, p. 1-13.
Nesma T. Aboulkhair et al., 3D printing of Aluminium alloys: Additive Manufacturing of Aluminium alloys using selective laser melting, Progress in Materials Science, 2019, vol. 106, No. 100578, p. 1-45.
Jyoti Suryawanshi et al., Simultaneous enhancements of strength and toughness in an Al—12Si alloy synthesized using selective laser melting, Acta Materialia, 2016, vol. 115, p. 285-294.
Priyanka Agrawal et al., Additively manufactured novel Al—Cu—Sc—Zr alloy: Microstructure and mechanical properties, Additive Manufacturing, 2021, vol. 37, No. 101623, p. 1-13.
Siqi Chen et al., Effect of heat treatment on the anisotropy in mechanical properties of selective laser melted AlSi10Mg, Materials Science & Engineering A, 2022, vol. 858, No. 144130, p. 1-12.
Zhangping Hu et al., Effect of scanning strategy on the anisotropy in microstructure and properties of Cu—Cr—Zr alloy manufactured by laser powder bed fusion, Journal of Alloys and Compounds, 2022, vol. 920, No. 165957, p. 1-10.
Bing Wei et al., Microstructure, cracking behavior and mechanical properties of René 104 superalloy fabricated by selective laser melting, Journal of Alloys and Compounds, 2021, vol. 867, No. 158377, p. 1-10.
Xinyu Zhang et al., Anisotropy in microstructure and mechanical properties of additively manufactured Ni-based GH4099 alloy, Journal of Materials Research and Technology, 2023, vol. 26, p. 6552-6564.
Pei Wang et al., Microstructural characteristics and mechanical properties of carbon nanotube reinforced Inconel 625 parts fabricated by selective laser melting, Materials and Design, 2016, vol. 112, p. 290-299.
Mang Ni et al., Anisotropic tensile behavior of in situ precipitation strengthened Inconel 718 fabricated by additive manufacturing, Materials Science & Engineering A, 2017, vol. 701, p. 344-351.
Abdul Shaafi Shaikh et al., Microstructure and mechanical properties of Haynes 282 superalloy produced by laser powder bed fusion, Materials Today Communications, 2021, vol. 26, No. 102038, p. 1-12.
Giulio Marchese et al., The role of texturing and microstructure evolution on the tensile behavior of heat-treated Inconel 625 produced via laser powder bed fusion, Materials Science & Engineering A, 2020, vol. 769, No. 138500, p. 1-11.
Zhenan Zhao et al., A comprehensive study of the anisotropic tensile properties of laser additive manufactured Ni-based superalloy after heat treatment, International Journal of Plasticity, 2022, vol. 148, No. 103147, p. 1-24.
Chee Koon Ng et al., Additive manufacturing of high-strength and ductile high entropy alloy CoCrFeNiW0.2 composites via laser powder bed fusion and post-annealing, Journal of Alloys and Compounds, 2022, vol. 906, No. 164288, p. 1-12.
Jeong Min Park et al., Synergetic strengthening of additively manufactured (CoCrFeMnNi) 99C1 high-entropy alloy by heterogeneous anisotropic microstructure, Additive Manufacturing, 2020, vol. 35, No. 101333, p. 1-15.
Xu-Han Gu et al., Anisotropy of microstructures and mechanical properties in FeCoNiCr0.5 high-entropy alloy prepared via selective laser melting, Rare Metals, 2022, vol. 41, p. 2047-2054.
Li-Xue Liu et al., Achieving high strength and ductility in a 3D-printed high entropy alloy by cooperative planar slipping and stacking fault, Materials Science & Engineering A, 2022, vol. 843, No. 143106, p. 1-8.
Pengda Niu et al., Additive manufacturing of TRIP-assisted dual-phases Fe50Mn30Co10Cr10 high-entropy alloy: Microstructure evolution, mechanical properties and deformation mechanisms, Materials Science & Engineering A, 2021, vol. 814, No. 141264, p. 1-10.
P. Agrawal et al., Excellent strength-ductility synergy in metastable high entropy alloy by laser powder bed additive manufacturing, Additive Manufacturing, 2020, vol. 32, No. 101098, p. 1-7.
Hongyu Chen et al., Laser additive manufacturing of nano-TiC particles reinforced CoCrFeMnNi high-entropy alloy matrix composites with high strength and ductility, Materials Science & Engineering A, 2022, vol. 833, No. 142512, p. 1-16.
Nicholas C. Ferreri et al., Effects of build orientation and heat treatment on the evolution of microstructure and mechanical properties of alloy Mar-M-509 fabricated via laser powder bed fusion, International Journal of Plasticity, 2019, vol. 121, p. 116-133.
Zhaowen Geng et al., Composition inhomogeneity reduces cracking susceptibility in additively manufactured AlCoCrFeNi2.1 eutectic high-entropy alloy produced by laser powder bed fusion, Additive Manufacturing, 2022, vol. 56, No. 102941, No. 1-14.
Quanquan Han et al., Additive manufacturing of high-strength crack-free Ni-based Hastelloy X superalloy, Additive Manufacturing, 2019, vol. 30, No. 100919, p. 1-11.
Jung-Uk Lee et al., Effects of hot isostatic pressing treatment on the microstructure and tensile properties of Ni-based superalloy CM247LC manufactured by selective laser melting, Materials Science & Engineering A, 2022, vol. 841, No. 143083, p. 1-12.
Wei-Chih Lin et al., Microstructure and tensile property of a precipitation strengthened high entropy alloy processed by selective laser melting and post heat treatment, Additive Manufacturing, 2020, vol. 36, No. 101601, p. 1-10.
Sean P. Murray et al., A defect-resistant Co—Ni superalloy for 3D printing, Nature Communications, 2020, vol. 11, No. 4975, p. 1-11.

* cited by examiner

MULTI-COMPONENT HIGH ENTROPY ALLOY WITH NANOSCALE ATOMIC SELF-ORDERING STRUCTURE AND PREPARATION METHODS THEREOF

FIELD OF THE INVENTION

The present invention generally relates to at least the fields of materials science and engineering, automotive, and aerospace, etc. More specifically, the present invention relates to multi-component high entropy alloys (HEAs).

BACKGROUND OF THE INVENTION

The emergence of 3D printing has brought revolutionary breakthroughs to the manufacturing field, known for its greater precision, enhanced design freedom, and manufacturing flexibility to directly fabricate complex geometries without moulds. Its rapid cooling rate is particularly adept at creating nanoscale microstructures.

Acro-engine is operated in high temperature, high speed and high stress environment for a long time, and the material performance requirements are incredibly severe. The turbine disk, a key component of the acro-engine, is the focus and difficulty of research and development. Compared with other components, it has the highest safety factor, and its performance also determines the overall performance of the aero-engine. Therefore, the aerospace industry urgently demands for alloys that can provide high temperature protection.

For geometric complexity structural engine components, the preferred material of choice is the class of high-performance precipitate-strengthened superalloys with a high-volume fraction of the ordered precipitates (i.e., $Ni_3$ (Al, Ti, Nb) and $Ni_3Nb$). For example, nickel-based superalloys strengthened by ordered $L1_2$ (γ') intermetallic compounds have been widely used to cope with extreme service conditions. However, a major drawback of these superalloys is lack of printability or weldability, prone to various types of cracking, such as solidification cracking, liquation cracking, ductility-dip cracking, and strain-age cracking. Such undesired cracking inevitably leads to poor mechanical properties. Another critical challenge is the anisotropy in microstructures and mechanical properties in the building direction (BD) and scanning direction (SD), limiting the practical utility of 3D-printed alloys. These limitations greatly restrict the applications of materials. Despite decades of research, strategies to achieve alloys through 3D printing that are near-void-free, exhibit ultrahigh strengths (gigapascal levels)-ductility synergy, and maintain isotropy in mechanical properties are still rare.

As such, there is a growing need to explore new structural materials. Co-based alloys exhibit higher temperature capacity due to the fact that Co melts at a higher-temperature than Ni. Recently, the discovery of ordered γ'-$Co_3$ (Al, W) intermetallic phases in the Co—Al—W ternary alloy systems has demonstrated the possibility of strengthening Co-based high-temperature structural materials with ordered precipitation.

Due to the long development cycle and high cost of new materials and processes, researchers have become interested in using new design concepts to control the superalloy composition. Currently, high entropy alloys with unique design concepts have attracted wide attention. It is known that multi-component high-entropy alloy has a variety of unique physical and mechanical properties, such as high strength under environment and high temperature, good radiation resistance and corrosion resistance. They are composed of at least five major elements, each of which has an atomic percentage between 5% and 35%, and each minor element (if it contains minor elements) has an atomic percentage of less than 5%.

At present, there is limited research on multi-component high-entropy alloys. Therefore, there is still an urgent need in the field for structural materials suitable for modern aerospace engineering and power generation industries.

SUMMARY OF THE INVENTION

Aiming to select structural materials for the development of modern aerospace engineering and power generation industry, the present invention provides a multi-component high entropy alloy with a new design to solve the shortcomings and deficiencies of the prior art, and its preparation methods are also provided.

In a first aspect, the present invention provides a multi-component high entropy alloy with nanoscale atomic self-ordering structure. The multi-component high entropy alloy includes a composition of cobalt (Co), nickel (Ni), chromium (Cr), aluminum (Al), titanium (Ti), molybdenum (Mo), tantalum (Ta), and niobium (Nb), and the multi-component high entropy alloy is represented by the formula:

$$Co_aNi_bCr_cAl_dTi_eMo_fTa_gNb_h,$$

where a, b, c, d, e, f, g, h, correspond to the atomic percentage of metal elements and, $10 \le a \le 70$, $10 \le b \le 50$, $0.1 \le c \le 20$, $0.1 \le d \le 20$, $0.01 \le e \le 10$, $0.01 \le f \le 10$, $0.1 \le g \le 10$, $0.01 \le h \le 10$.

In one embodiment, the multi-component high entropy alloy is a near-void-free alloy, and the multi-component high entropy alloy exhibits the nanoscale atomic self-ordering structure with dimensions ranging from 1 to 5 nm.

In one embodiment, the multi-component high entropy alloy has a relative density of at least 95% compared to a reference material.

In another embodiment, the composition comprises 30-50 at. % cobalt (Co), 20-40 at. % Ni, 1-15 at. % Cr, 1-15 at. % Al, 0.1-5.0 at. % Ti, 0.5-5 at. % Mo, 0.5-5 at. % Ta, and 0.1-5 at. % Nb.

In yet another embodiment, the composition comprises 36-45 at. % Co, 26-32 at. % Ni, 7-12 at. % Cr, 8-13 at. % Al, 0.5-3 at. % Ti, 0.6-2.5 at. % Mo, 0.7-2.6 at. % Ta, and 0.7-2.2 at. % Nb.

In one embodiment, the multi-component high entropy alloy has diffraction angles (2θ) at which the peaks occur in the X-ray diffraction (XRD) pattern as follows: 43.53°, 50.52°, 74.55°, 90.35°, and 95.70°.

In one embodiment, the multi-component high entropy alloy has a size distribution ranging from 10 μm to 100 μm.

In one embodiment, the multi-component high entropy alloy has an ultimate tensile strength of at least 1 GPa.

In one embodiment, the multi-component high entropy alloy has a uniform elongation of at least 15.0% under tension at ambient temperature.

In one embodiment, the multi-component high entropy alloy has a sphericity of at least 90%.

In another aspect, the present invention provides a method for preparing a multi-component high entropy alloy, including weighting and blending metal powders to obtain a mixture; degassing and slagging the mixture to obtain a composition; forming an alloy liquid in a vacuum induction furnace and casting the liquid into an alloy ingot; processing the alloy ingot into spherical alloy powder; and melting and solidifying the spherical alloy powder by selective laser to obtain the multi-component high entropy alloy with a nanoscale atomic self-ordering structure with dimensions ranging from 1 to 5 nm.

In one embodiment, the composition comprises 10-70 at. % cobalt (Co), 10-50 at. % Ni, 0.1-20 at. % Cr, 0.1-20 at. % Al, 0.01-10 at. % Ti, 0.01-10 at. % Mo, 0.1-10 at. % Ta, and 0.01-10 at. % Nb.

In another embodiment, the composition comprises 30-50 at. % cobalt (Co), 20-40 at. % Ni, 1-15 at. % Cr, 1-15 at. % Al, 0.1-5.0 at. % Ti, 0.5-5 at. % Mo, 0.5-5 at. % Ta, and 0.1-5 at. % Nb.

In one embodiment, the step of degassing and slagging the mixture to obtain a composition occurs in an inert atmosphere and is conducted at 1500-1600° C. for 5-10 minutes.

In one embodiment, the temperature within the vacuum induction furnace is controlled at 1400-1450° C.

In one embodiment, the step of processing the alloy ingot into spherical alloy powder is carried out using plasma rotation click atomization, and the step occurs at a working speed of 40,000 rpm to 50,000 rpm and a working pressure of 6 MPa to 10 MPa.

In one embodiment, the multi-component high entropy alloy has a size distribution ranging from 10 μm to 100 μm.

In one embodiment, the multi-component high entropy alloy has a sphericity of at least 90%.

The present invention prepares products with complex shapes of the multi-component Co-rich high entropy alloy (MCoHEA) by combining the selective laser melting technology. Compared with the traditional casting and forging welding, it can greatly shorten the production cycle, reduce the production cost, and can be industrialized.

Regarding physical properties, the tensile strength and uniform elongation of the multi-component high entropy alloys prepared by selective laser melting are much higher than other high entropy or high entropy alloys (such as EP718 superalloy, 625 superalloy, CoCrFeMnNi and other high entropy alloys) prepared by selective laser melting, which means that the alloys of the present invention are expected to increase the service life of the final product. For example, different from the reported high entropy or high temperature alloy melting by selective laser, the printed MCoHEA of the present invention has a high tensile strength up to 1.50 GPa and a high uniform elongation up to 22.5% after the forming process.

Also, the density of selected laser melting MCoHEA alloy is much higher than other selected laser melting alloys (such as EP718 superalloy, 625 superalloy, CoCrFcMnNi and other high entropy alloys), which means that MCoHEA alloy has better formability.

BRIEF DESCRIPTION OF THE DRAWINGS

Embodiments of the invention are described in more details hereinafter with reference to the drawings, in which.

Figure 10A:
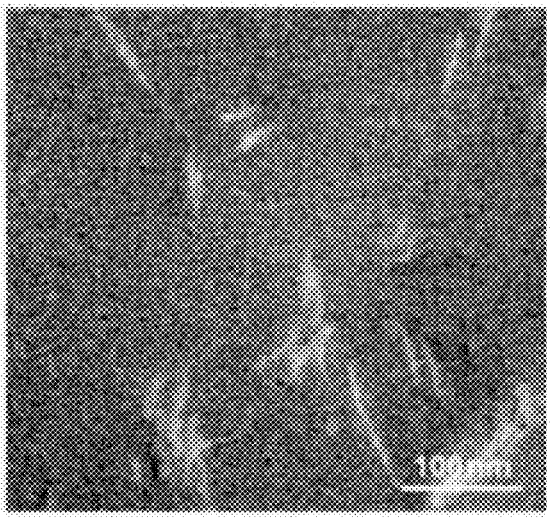
Figure 10B:
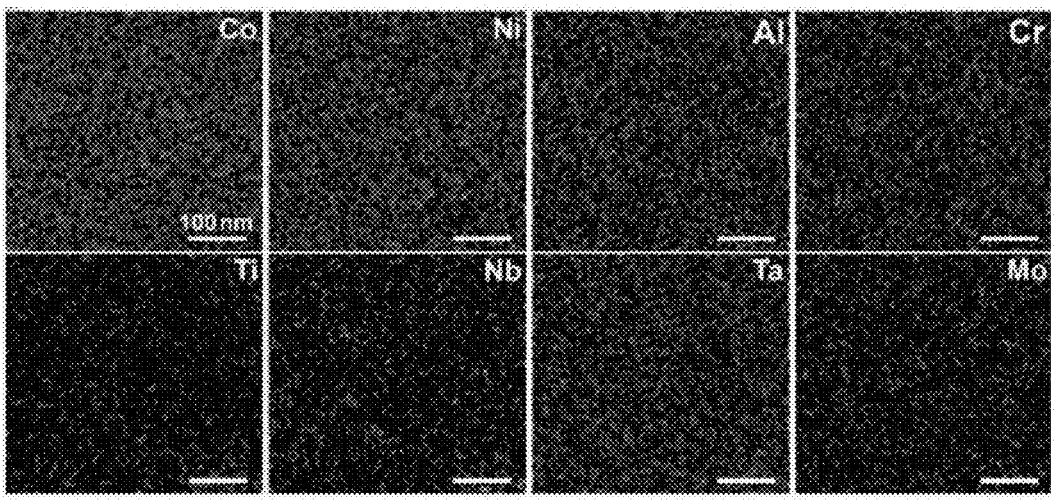
Figure 10C:
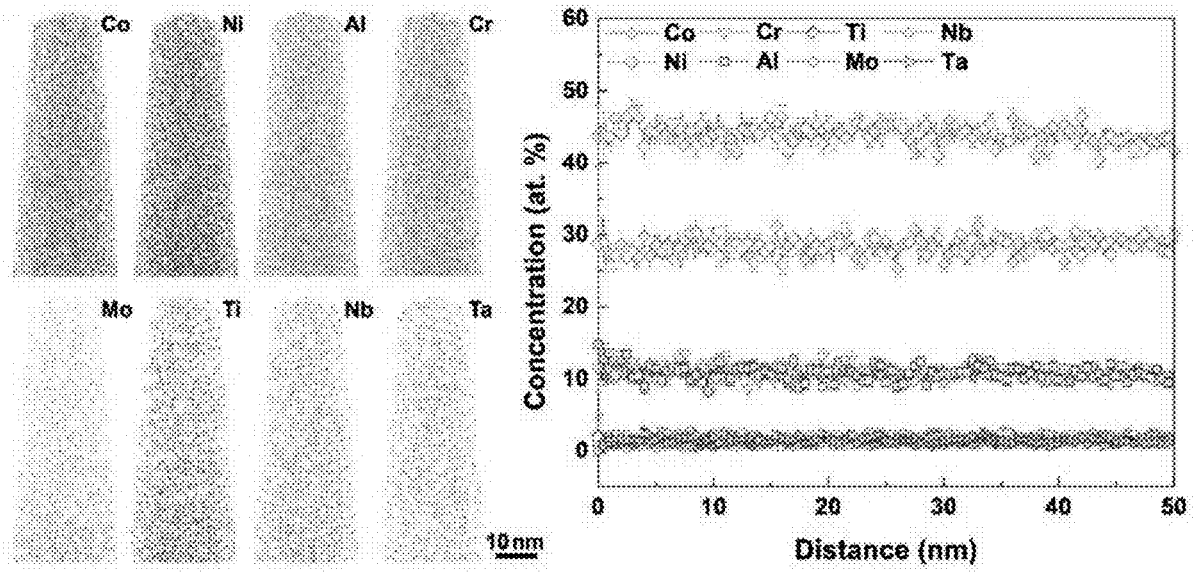
Figure 11A:
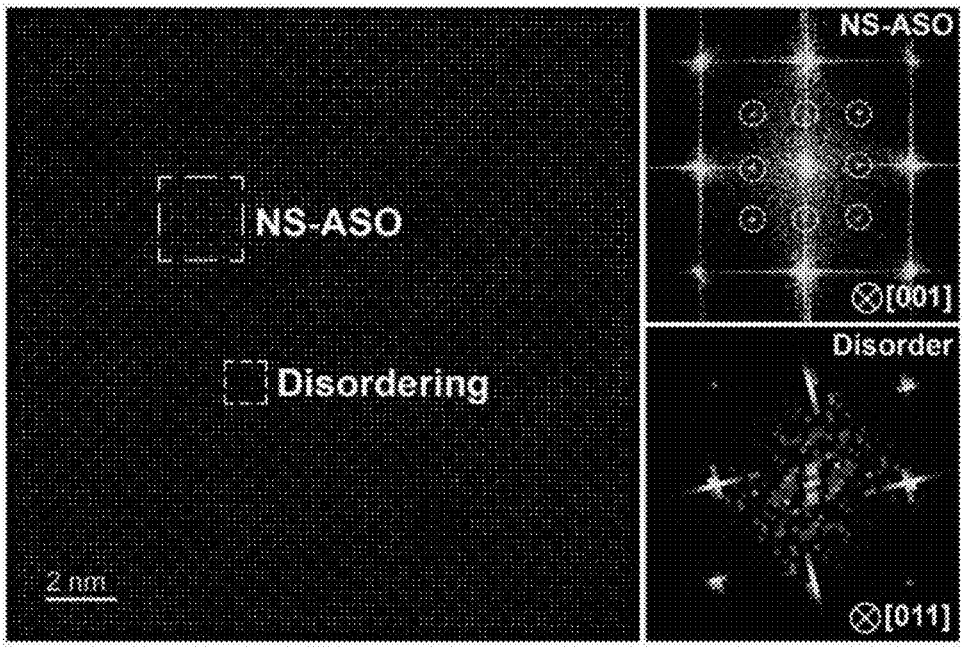
Figure 11B:
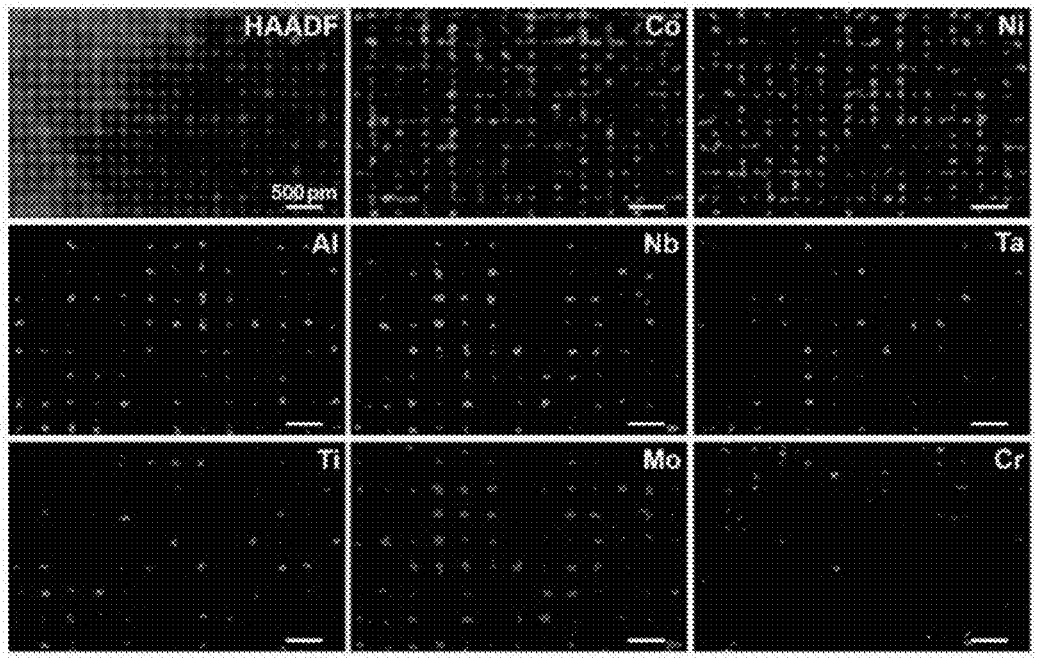
Figure 12:
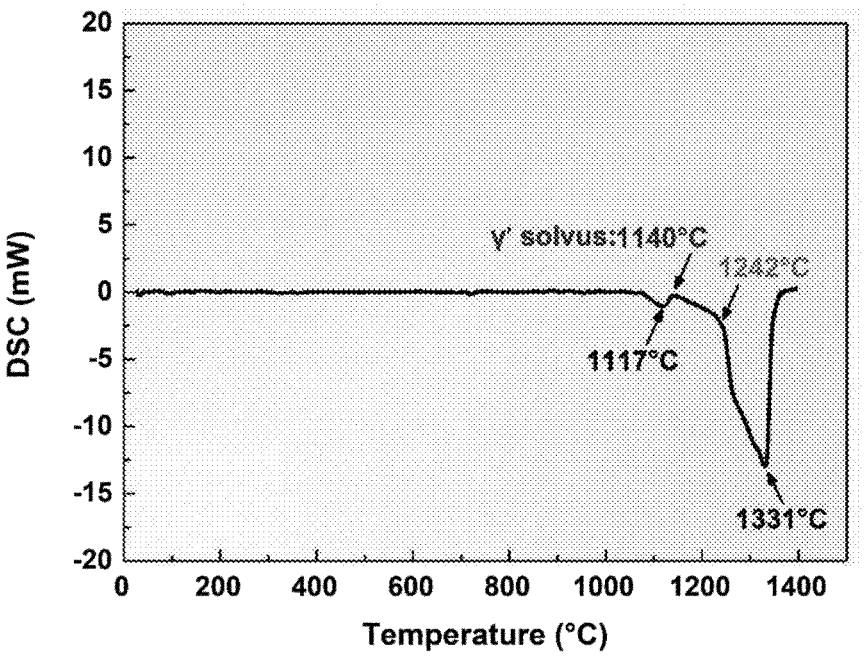
Figure 13A:
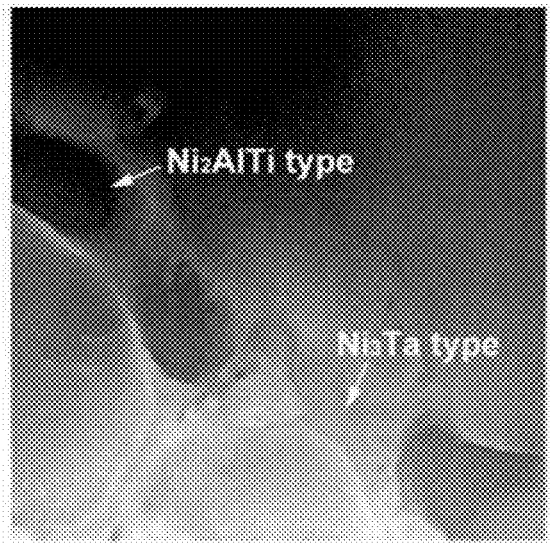
Figure 13B:
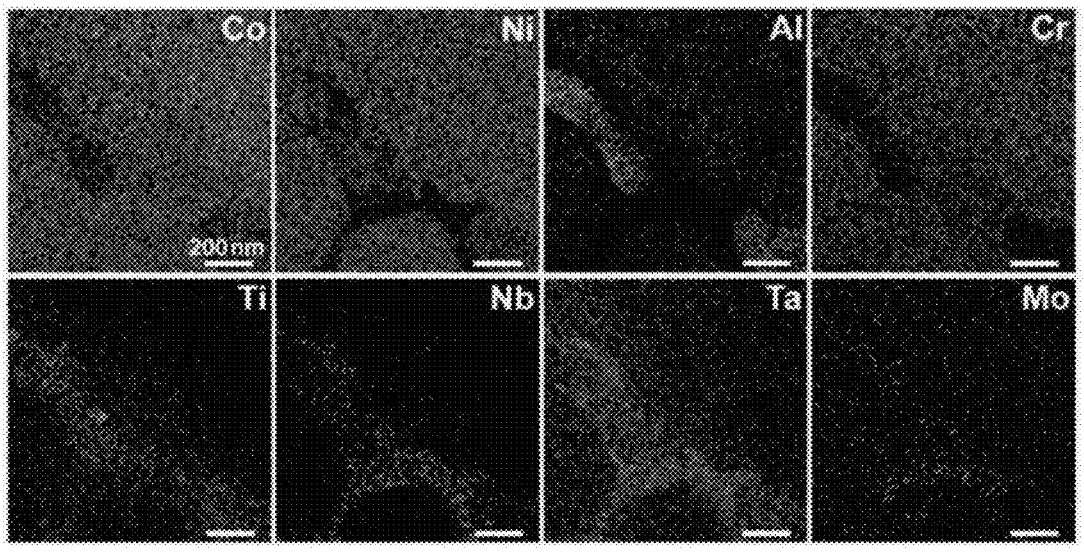
Figure 13C:
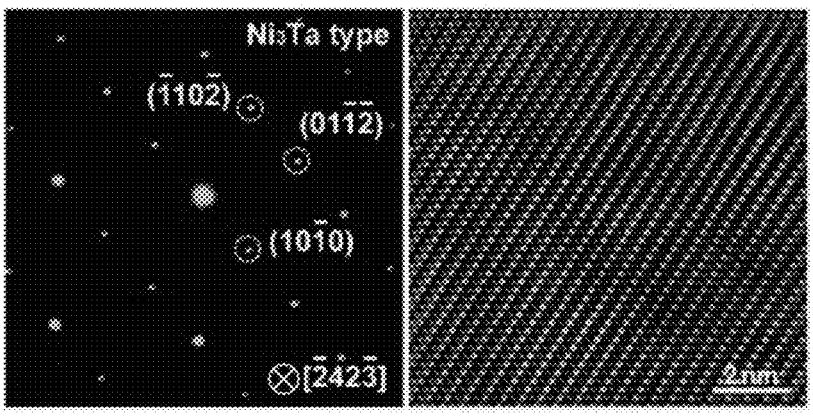
Figure 13D:
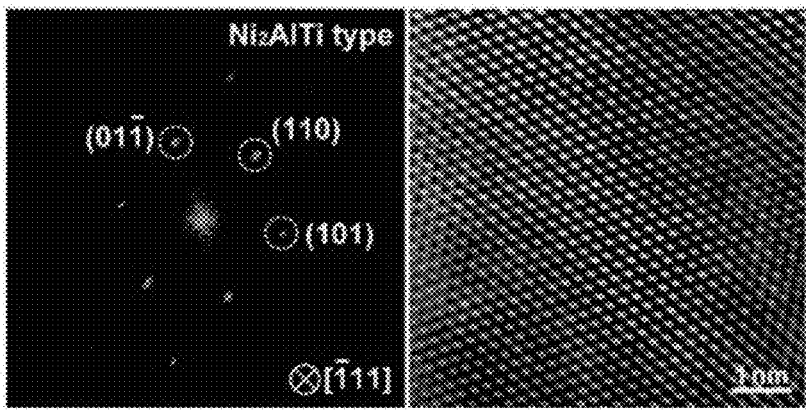
Figure 14A:
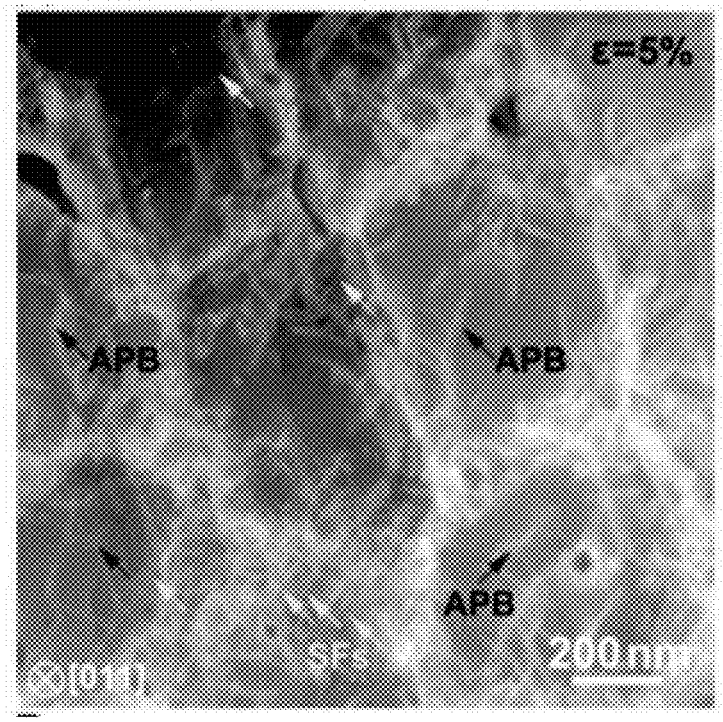
Figure 14B:
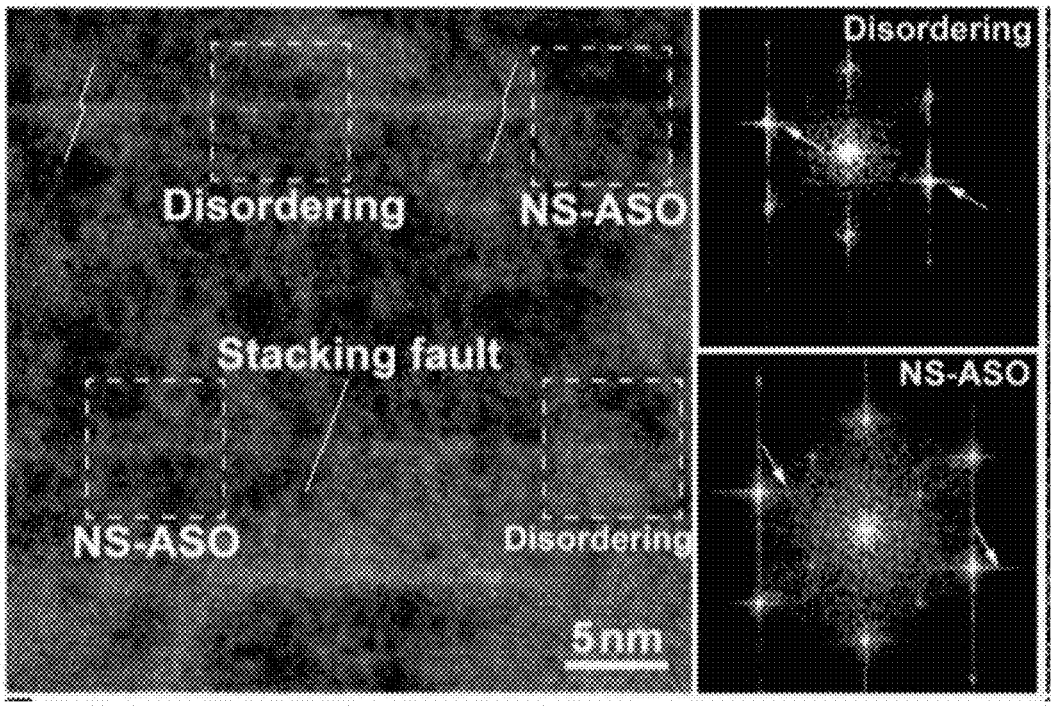
Figure 14C:
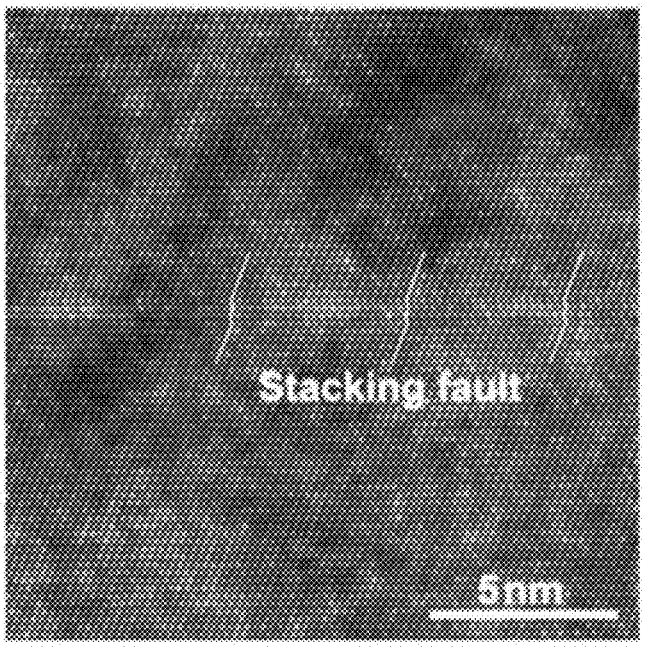
Figure 14D:
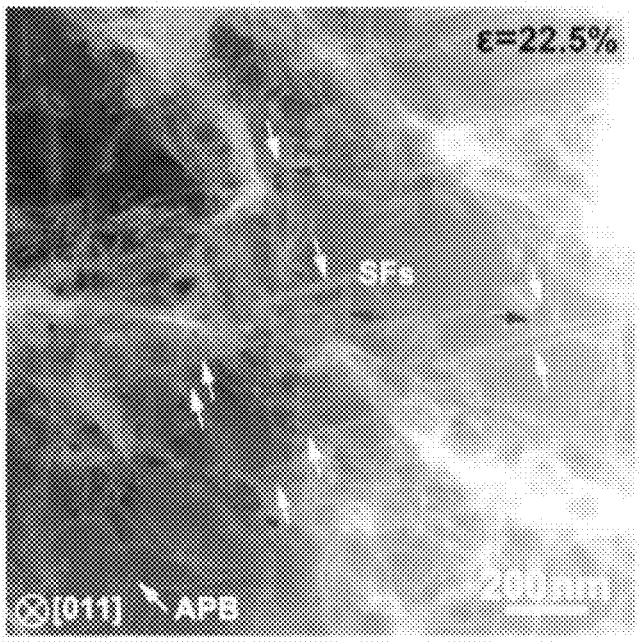
Figure 14E:
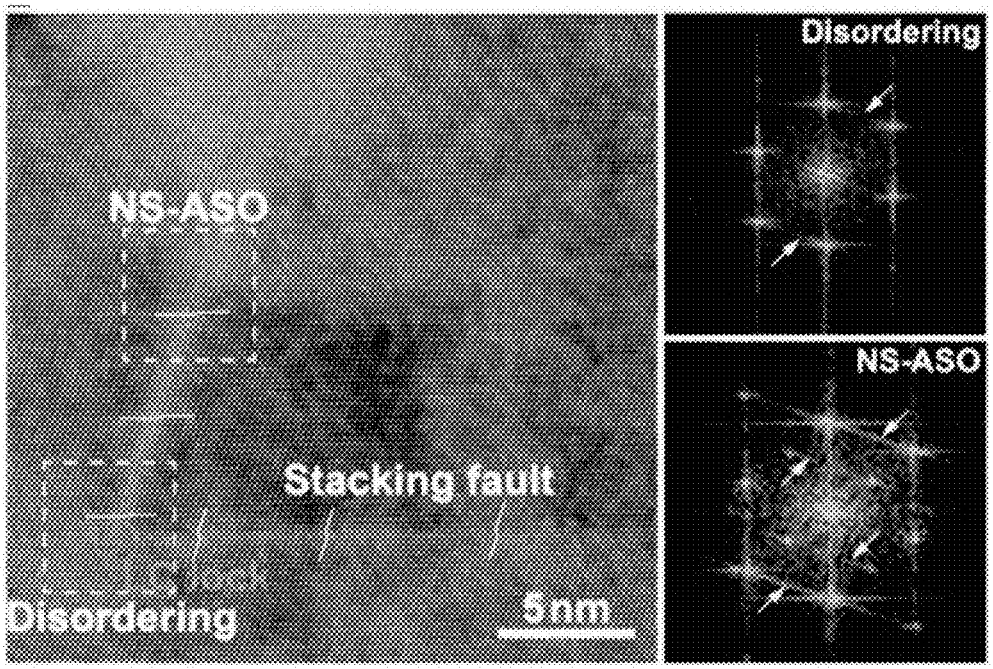
Figure 14F:
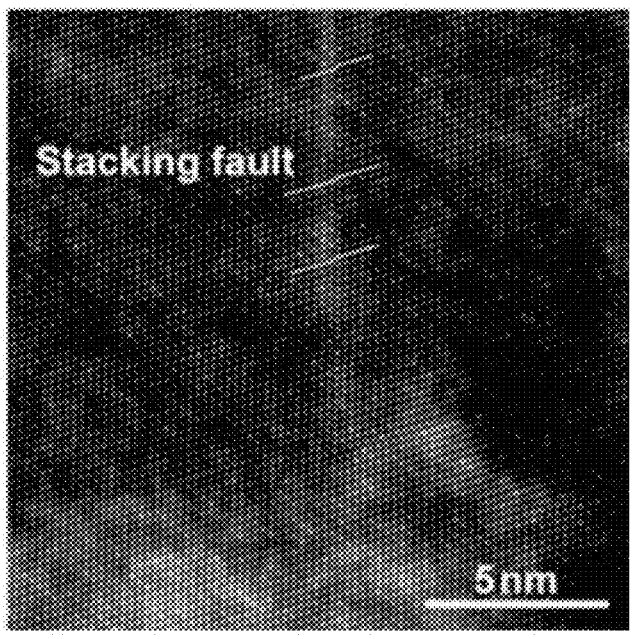
Figure 15A:
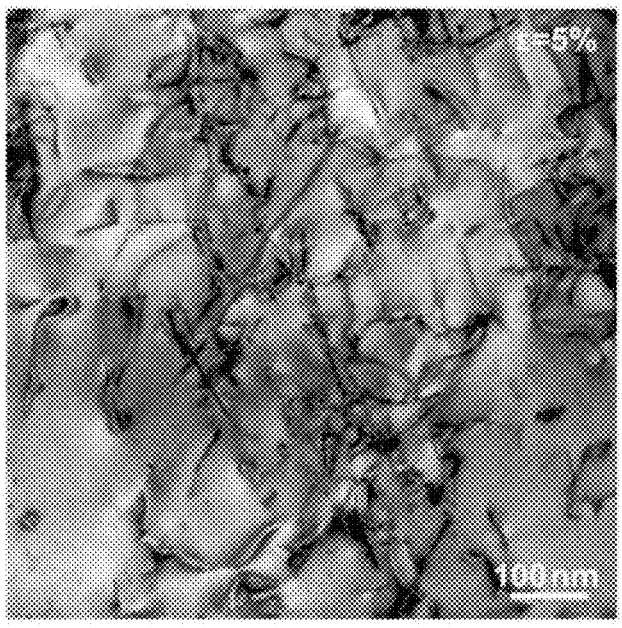
Figure 15B:
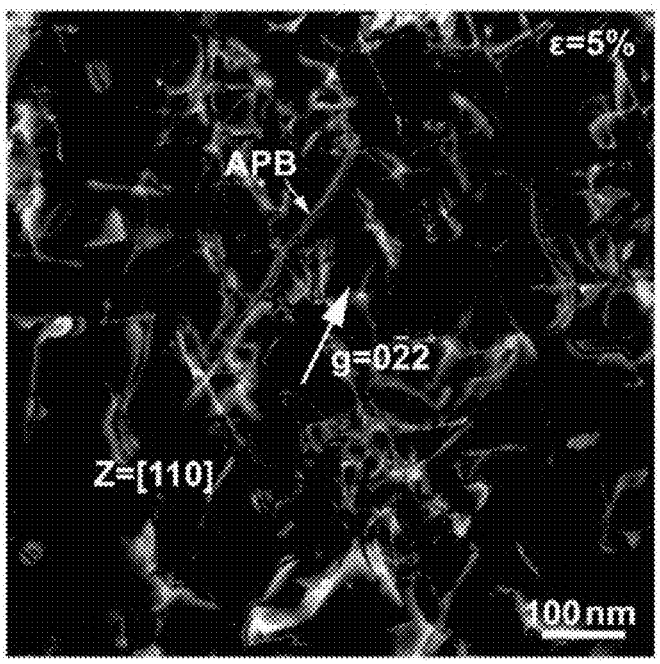
Figure 15C:
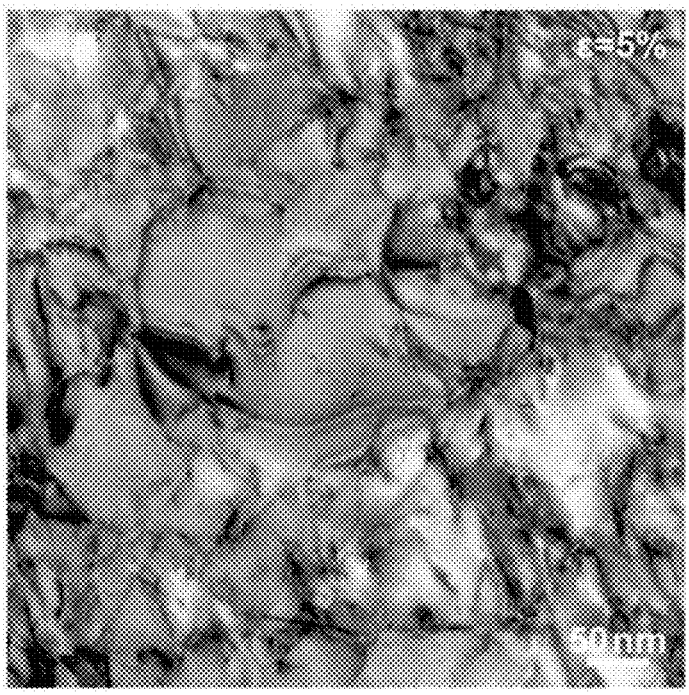
Figure 15D:
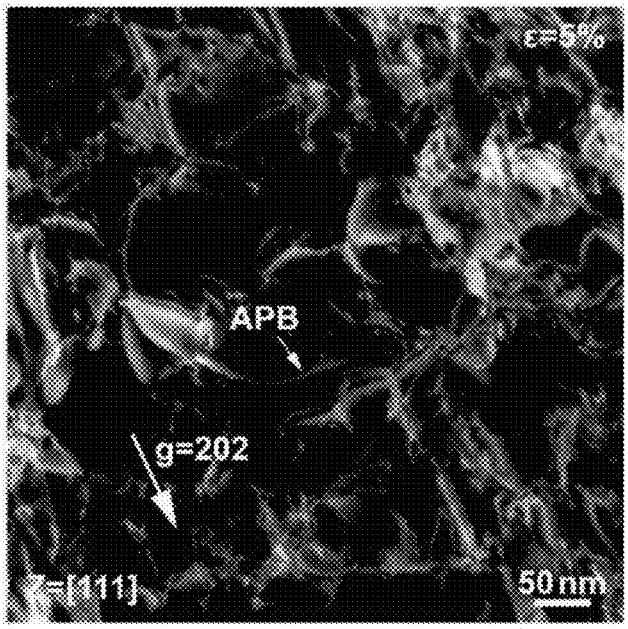
Figure 16A:
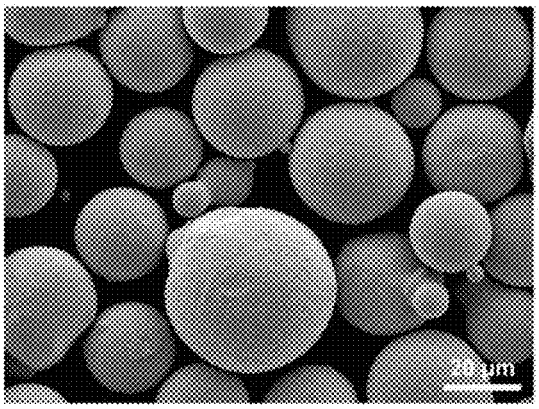
Figure 16B:
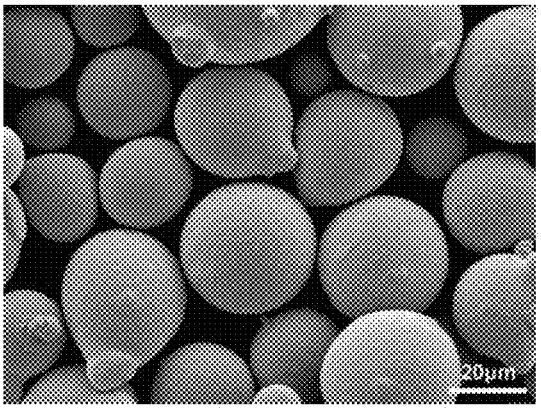
Figure 16C:
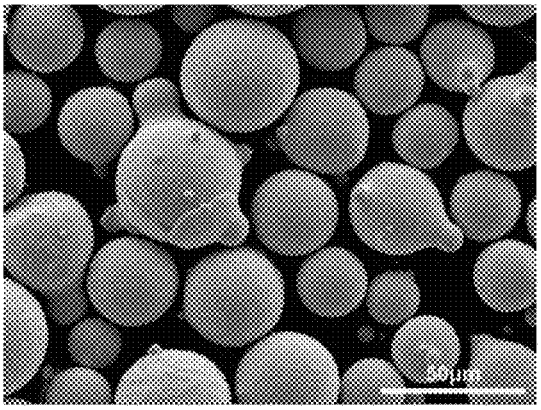
Figure 17:
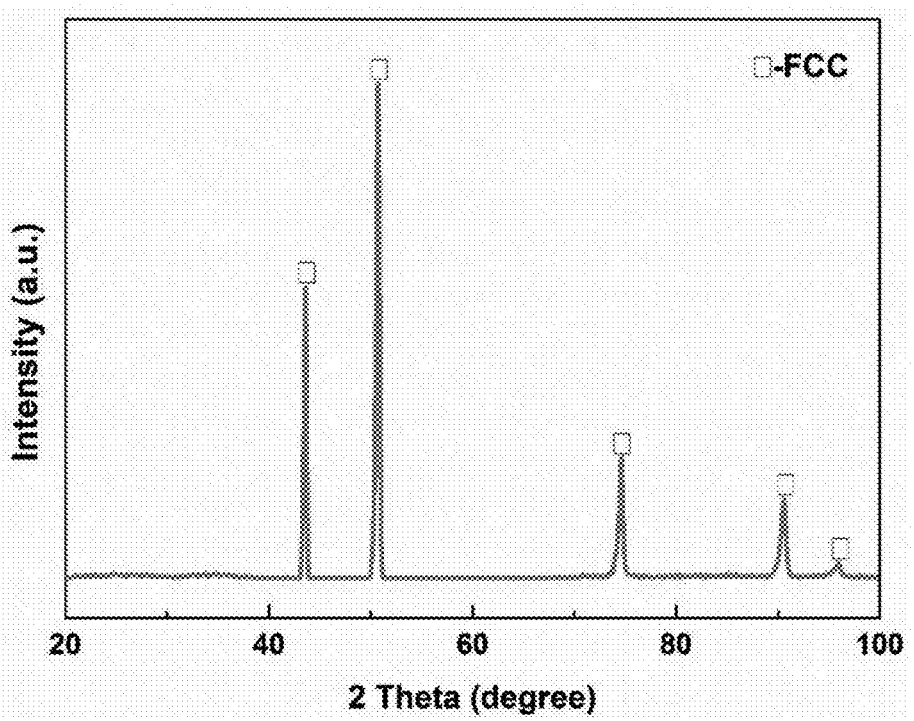
Figure 18:
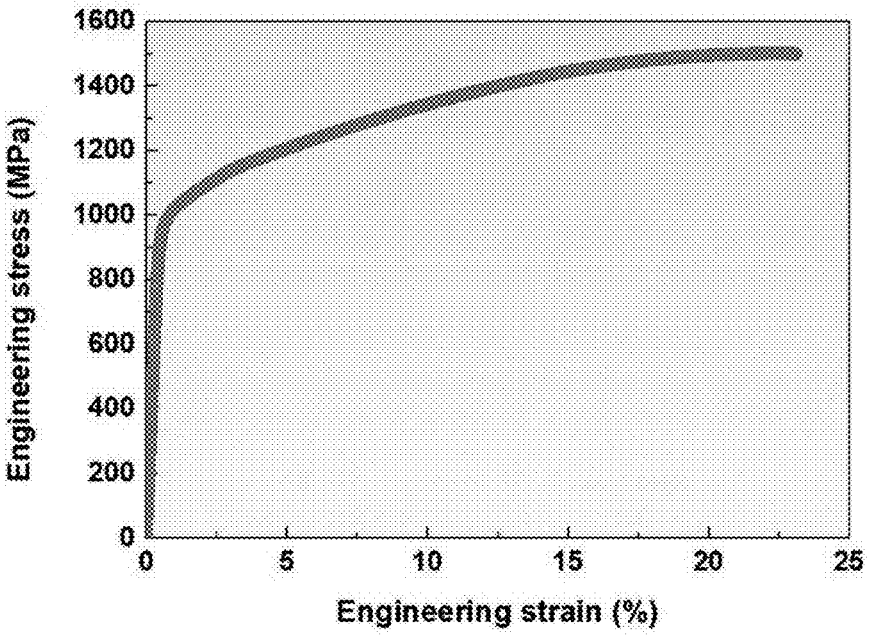
Figure 19A:
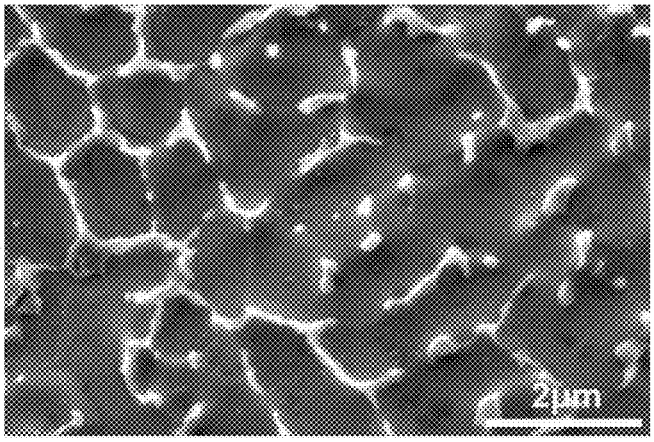
Figure 19B:
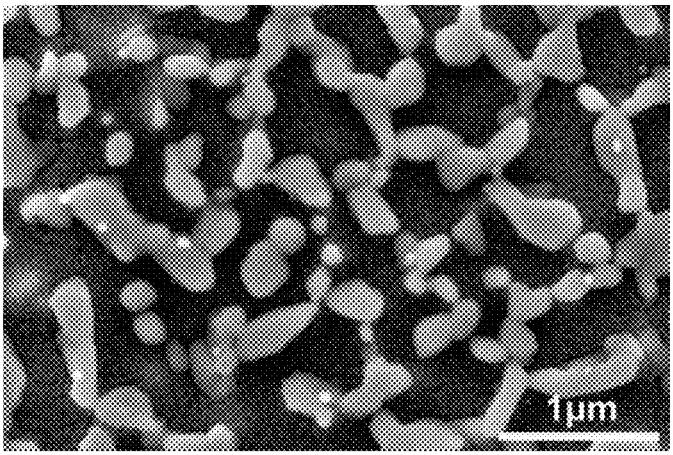
Figure 20:
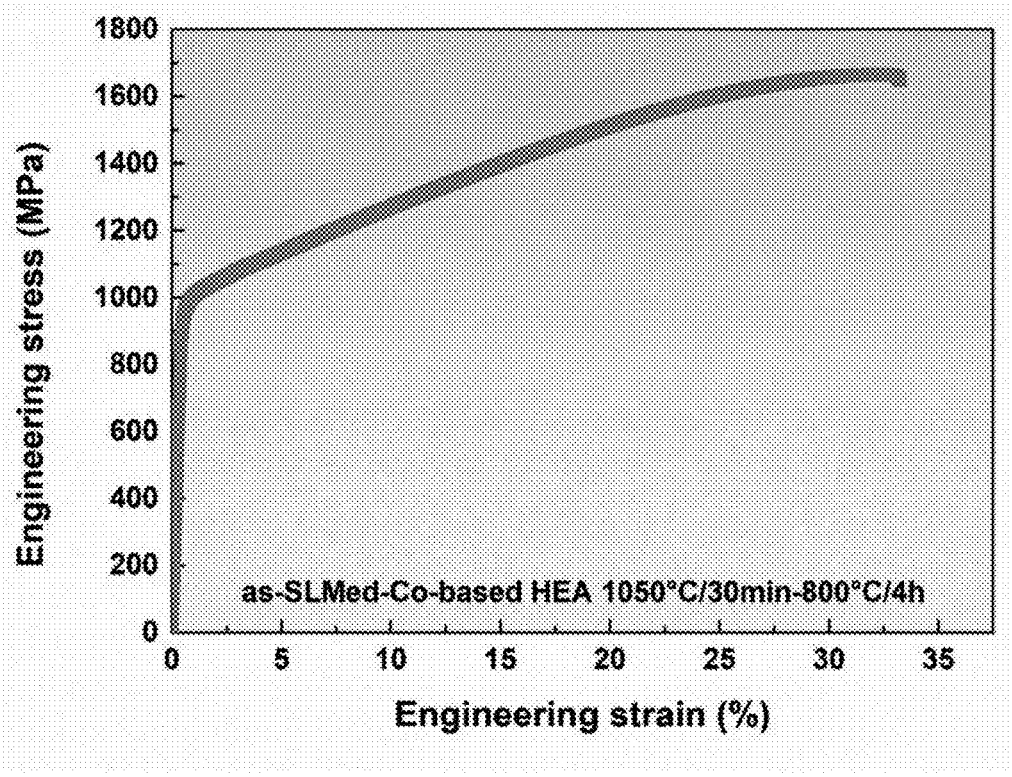
Figure 21:
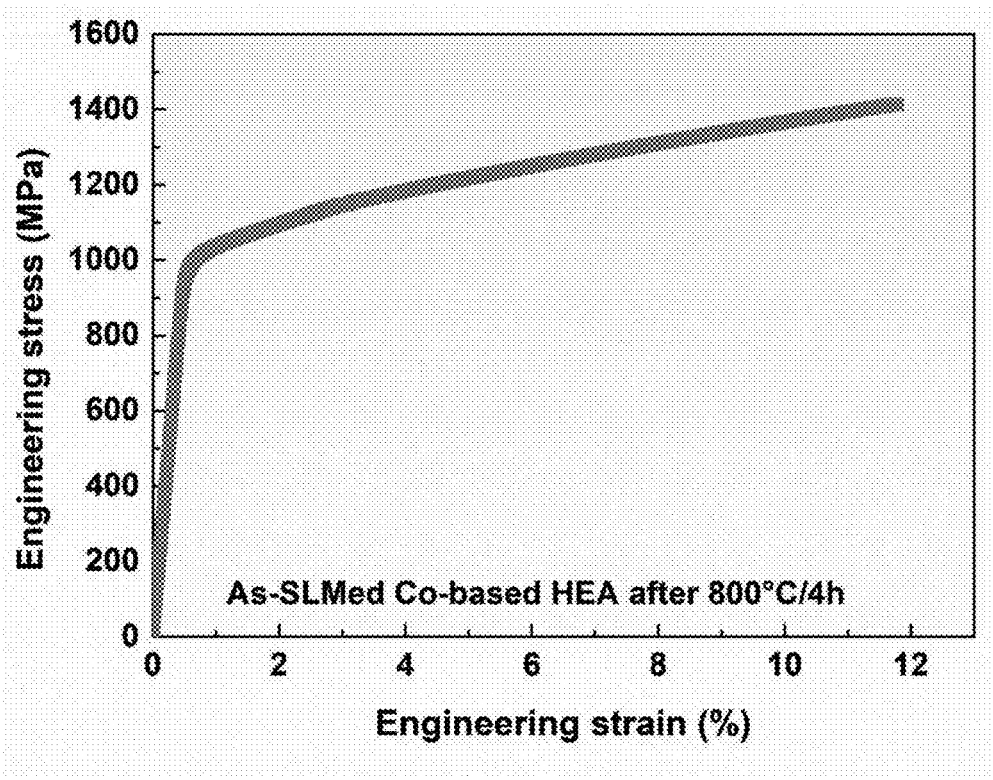
Figure 22A:
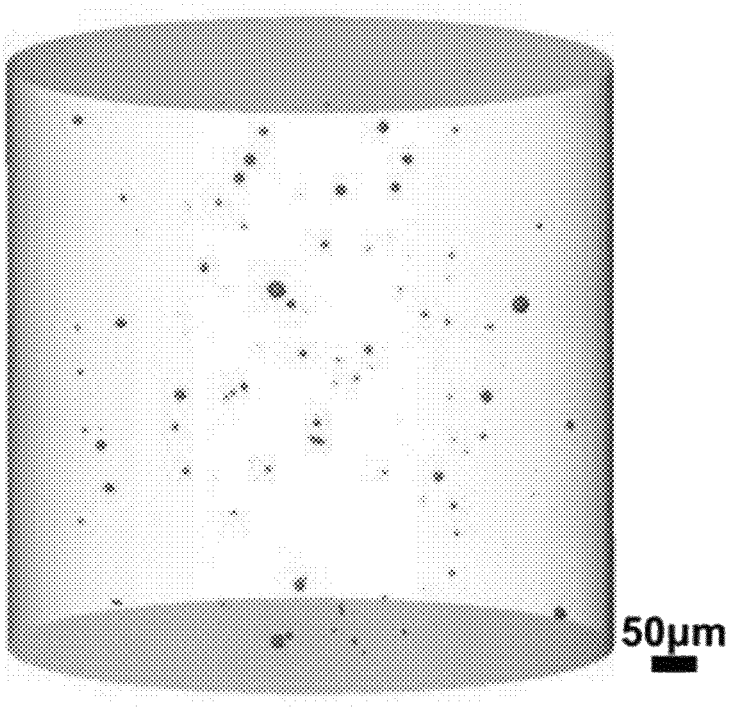
Figure 22B:
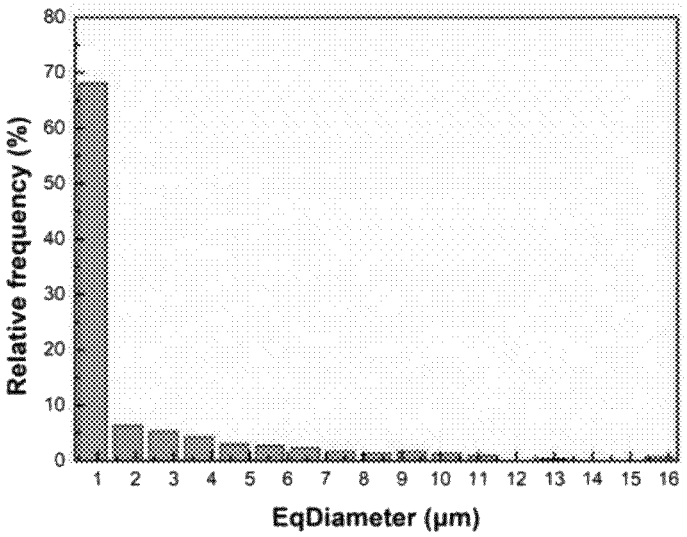

$\sigma_y)/\sigma_x]\times100\%$, where $\sigma_x$ and $\sigma_z$, separately denote the yield strength and elongation in SD and BD planes;

FIGS. 10A-10C show HAADF image, EDS mappings corresponding to the HAADF image in FIG. 10A, atom maps showing the uniform distribution of Co, Ni, Al, Cr, Ti, Nb, Ta, and Mo elements. The scale bar is 10 nm. One-dimensional (1D) compositional profile reveals the elemental distributions in the dislocation cell;

FIG. 11A shows a HR-TEM image, the fast Fourier transform (FFT) patterns reveal that the NS-ASO structure and disordered structure. FIG. 11B shows atomic-resolution HAADF-STEM image and corresponding EDX mappings taken from the NS-ASO structure, revealing the sublattice occupations;

FIG. 12 shows typical DSC heating curves (The materials tested is L-PBF materials after 1050° C./30 min-800° C./4 h heat treatment);

FIGS. 13A-13B show HAADF image, EDS mappings corresponding to the HAADF image in FIG. 13A. FIG. 13C shows SAED and HRTEM images revealing the existence of hep $Ni_3Nb$ phase and bcc NizAlNb phase. FIG. 13D shows HR-TEM image revealing the NS-ASO structure and the blue and orange images show the corresponding fast Fourier transform (FFT) patterns of the NS-ASO structure and disordered structure;

FIG. 14A shows a deformation substructure at the 5% strain revealing the activation of parallel SFs. FIG. 14B shows HAADF-STEM images showing the parallel SFs in {111} slip systems. The FFT images revealing the SFs could cross the NSASO and disordering. FIG. 14C shows an enlarged view of a representative SF. FIG. 14D shows a deformation microstructure at the 22.5% strain revealing the high-density hierarchical SFs on different {111} slip planes. FIG. 14E shows a HRTEM image showing the lomer-Cotterell (LC) locks. The FFT images revealing the SFs could cross the NS-ASO and disordering. FIG. 14F shows an enlarged view of a representative SF;

FIGS. 15A-15B show BF and weak beam dark field (WBDF) images showing the superlattice dislocation pairs, which is collected from the g/3 g direction, with g=0-22 at the zone axis. FIGS. 15C-15D show BF and weak beam dark field (WBDF) images showing the superlattice dislocation pairs, which is collected from the g/3 g direction, with g=220 at the zone axis;

FIG. 16A depicts SEM image showing the morphology of Co-based HEA powder (MCoHEA-1). FIG. 16B depicts SEM image showing the morphology of Co-based HEA powder (MCoHEA-2). FIG. 16C depicts SEM image showing the morphology of Co-based HEA powder (MCoHEA-3);

FIG. 17 depicts XRD pattern of the Co-based HEA;

FIG. 18 depicts a tensile stress-strain curve of the as-built Co-based HEA test in ambient temperature;

FIG. 19A depicts a microstructure morphology of as-built Co-based HEA. FIG. 19B depicts a microstructure morphology of as-built Co-based HEA after 1050° C./30 min plus 800° C./4 h heat treatment. The scale bars are 2 μm and 1 μm, respectively;

FIG. 20 depicts a tensile stress-strain curve of the as-built Co-based HEA after 1050° C./30 min plus 800° C./4 h heat treatment test in ambient temperature;

FIG. 21 depicts a tensile stress-strain curve of the as-built Co-based HEA after 800° C./4 heat treatment test in ambient temperature; and FIG. 22A depicts distribution and morphology of pores in 3D visualization by micro-CT analysis. FIG. 22B depicts pore diameter distribution.

DETAILED DESCRIPTION

In the following description, multi-component high entropy alloys (HEAs) and their preparation process are set forth as preferred examples. It will be apparent to those skilled in the art that modifications, including additions and/or substitutions may be made without departing from the scope and spirit of the invention. Specific details may be omitted so as not to obscure the invention; however, the disclosure is written to enable one skilled in the art to practice the teachings herein without undue experimentation.

Additive Manufacturing (AM), also known as 3D printing, uses computer-aided design (CAD), material processing, and molding techniques to fabricate specialized materials layer by layer using software and numerical control systems based on digital model files. A method of directly manufacturing 3D solid parts identical to corresponding digital models. It has the characteristics of a simple process, a short processing cycle, and high material utilization rate. This makes it possible to manufacture complex structural parts, which cannot be realized due to the constraints of traditional manufacturing methods in the past, and topological optimization of the model structure could be carried out according to the needs.

$L1_2$ is a crystal structure that is often used as a strengthening mechanism in alloys. It consists of a face-centered cubic (FCC) lattice with ordered arrangements of atoms, which can enhance the mechanical properties of the material. In the context of multi-component Co-rich high entropy alloys, $L1_2$ refers to the ordered arrangement of atoms in the crystal structure of the alloy that provides enhanced mechanical properties, such as increased strength and hardness.

The present invention utilizes 3D printing, specifically its extreme printing parameters, in conjunction with the composition of cobalt (Co), nickel (Ni), chromium (Cr), aluminum (Al), titanium (Ti), molybdenum (Mo), tantalum (Ta), and niobium (Nb) to develop a new $L1_2$ reinforced multi-component Co-rich high entropy alloy (MCoHEA), which is a nearly void-free HEAs, and has high density and excellent strength and ductility mechanical properties. In the SLM process, a high-energy laser beam is precisely directed onto metal powder, selectively melting it layer by layer. This controlled melting process gradually builds up a three-dimensional object with high precision and intricate detail. The working principle of SLM revolves around precise computer control of both the positioning and intensity modulation of the laser beam throughout each layer-building phase. This intricate process ensures that the laser beam is accurately directed onto specific areas of the metal powder bed, melting it according to the digital design. By controlling the laser's intensity, the amount of energy delivered to the powder can be finely adjusted, allowing for the precise melting and solidification required to build up complex three-dimensional objects with exceptional accuracy and structural integrity.

The HEAs are characterized by high-density nanoscale atomic self-ordering (NS-ASO) structures. Such NS-ASO structures facilitates the overcoming of barriers susceptible to cracking often observed in precipitate-strengthened alloys with a high (Al+Ti+Nb+Ta) content exceeding 6.0 wt. %, while also fully guaranteeing the strengthening effect of the ordered precipitates. Additionally, these structures maintain a high work hardening rate and plastic deformation capacity. These findings provide an efficient routine to fabricate near-void-free alloys with an exceptional 99.998% relative density. They exhibit unprecedented isotropy in mechanical properties, boasting impressive strengths of approximately 1.54 GPa and a uniform elongation as high as approximately 22.5% under tension at ambient temperature.

In one embodiment, the composition of the multi-component high entropy alloy includes 10-70 at. % cobalt (Co), 10-50 at. % nickel (Ni), 0.1-20 at. % chromium (Cr), 0.1-20 at. % aluminum (Al), 0.01-10.0 at. % titanium (Ti), 0.01-10 at. % molybdenum (Mo), 0.1-10 at. % tantalum (Ta), and 0.01-10 at. % niobium (Nb).

Preferably, the composition of the multi-component high entropy alloy includes 30-50 at. % cobalt (Co), 20-40 at. % nickel (Ni), 1-15 at. % chromium (Cr), 1-15 at. % aluminum (Al), 0.1-5.0 at. % titanium (Ti), 0.5-5 at. % molybdenum (Mo), 0.5-5 at. % tantalum (Ta), and 0.1-5 at. % niobium (Nb).

In one embodiment, the present invention provides a more diverse range of high-entropy alloys with a molecular formula of $Co_aNi_bCr_cAl_d\ Ti_eMo_fTa_gNb_h$, where a, b, c, d, e, f, g, h, correspond to the atomic percentage of metal elements and, $36 \le a \le 45$, $26 \le b \le 32$, $7 \le c \le 12$, $8 \le d \le 13$, $0.5 \le e \le 3$, $0.6 \le f \le 2.5$, $0.7 \le g \le 2.6$, $0.7 \le h \le 2.2$.

Preferably, the composition of HEAs includes $Co_{43.1}Ni_{28.8}Cr_{10.2}Al_{10.0}Ti_{2.1}Nb_{2.2}Ta_{1.5}Mo_{2.1}$.

The addition of Ni serves to widen the γ' phase region while also inhibiting the formation of harmful intermetallic phases. The addition of Al and Cr can improve oxidation resistance and maintain low γ/γ' lattice mismatches. The use of Ti, Mo, Ta, and Nb is to replace the high-density W, which can reduce the mass density without destroying the microstructure of γ/γ'.

The HEA also feature an outstanding work-hardening capacity of approximately 530 megapascals. The ultrahigh strength primarily originates from the ordering strengthening, while substantial ductility is attributed to a progressive work-hardening mechanism regulated by the coherent NS-ASO architectures.

The present invention also provides a method for preparing the multi-component high entropy alloy, including:

(1) weighting and blending designated elemental metal powders of Co, Ni, Cr, Al, Ti, Mo, Ta, and Nb according to their atomic percentages in the molecular formula;

(2) performing degassing and slagging processes to achieve the desired composition;

(3) forming an alloy liquid within a vacuum induction furnace and subsequently casting the liquid into an alloy ingot.

(4) transforming the alloy ingot into spherical alloy powder using plasma rotation click atomization technology at a working speed of 40,000 rpm to 50,000 rpm and a working pressure of 6 MPa to 10 MPa.

(5) melting and solidifying the spherical alloy powder by selective laser to produce a multi-component high entropy alloy with high-density nanoscale atomic self-ordering structure, which has high density and excellent strong plastic energy.

The raw materials are fully matured, available at an inexpensive price, and the milling technology has been proficiently mastered.

Compared with traditional processing methods such as casting and forging, laser 3D printing technology can quickly achieve near net forming. The technology has simple process flow, low cost and short production cycle.

The resulting multi-component high entropy alloy has a particle size distribution between 10 μm to 100 μm, with an average particle size ranging from 10 μm to 50 μm. The sphericity of the spherical powder is greater than 90%.

In one embodiment, the resulting multi-component high entropy alloy has a particle size distribution between 15 μm to 80 μm, with an average particle size ranging from 20 μm to 40 μm. The sphericity of the spherical powder is greater than 92.5%.

Preferably, the resulting multi-component high entropy alloy has a particle size distribution between 20 μm to 65 μm, with an average particle size ranging from 28 μm to 37 μm. The sphericity of the spherical powder is greater than 95%.

In one embodiment, the resulting multi-component high entropy alloy has a density of at least 90%, a strength of at least 1 GPa, and a uniform elongation of at least 15.0%.

In one embodiment, the resulting multi-component high entropy alloy has a density of at least 95%, a strength of at least 1.2 GPa, and a uniform elongation of at least 20.0%.

Preferably, the resulting multi-component high entropy alloy has a density of 99.997%, a strength of up to 1.5 GPa, and a uniform elongation of up to 22.5%.

The excellent strength-ductility matching means that the multi-component high entropy alloy (e.g., MCoHEA) can provide higher safety, more beneficial to energy conservation and emission reduction. In addition, additive manufacturing technology can prepare a variety of complex shape structural parts, which can significantly shorten the preparation cycle, save raw materials and costs, and realize large-scale production.

EXAMPLE

Example 1

Characterization of HEA Powders Processed Through SLM

Figure 1A:
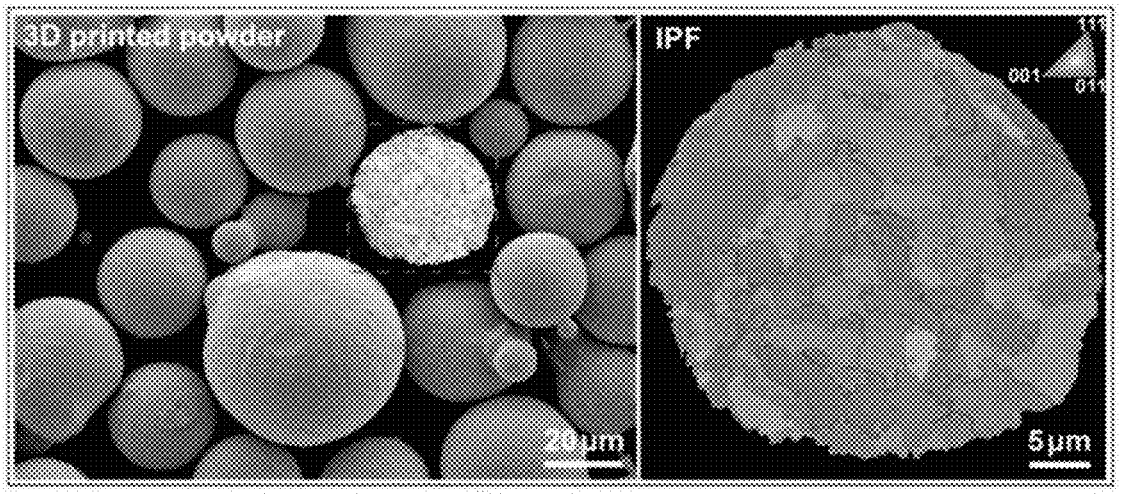
FIG. 1A shows the HEA powders fabricated by gas atomization.

The HEA powders were produced using gas atomization method, achieving good sphericity and a particle size distribution of D (10)=22.26, D (50)=35.16, and D (90)=48.34. Electron backscatter diffraction (EBSD) analysis revealed that a polycrystalline morphology with an average grain size of approximately 7 μm, and a random orientation distribution can be found (FIG. 1A).

Figure 1B:
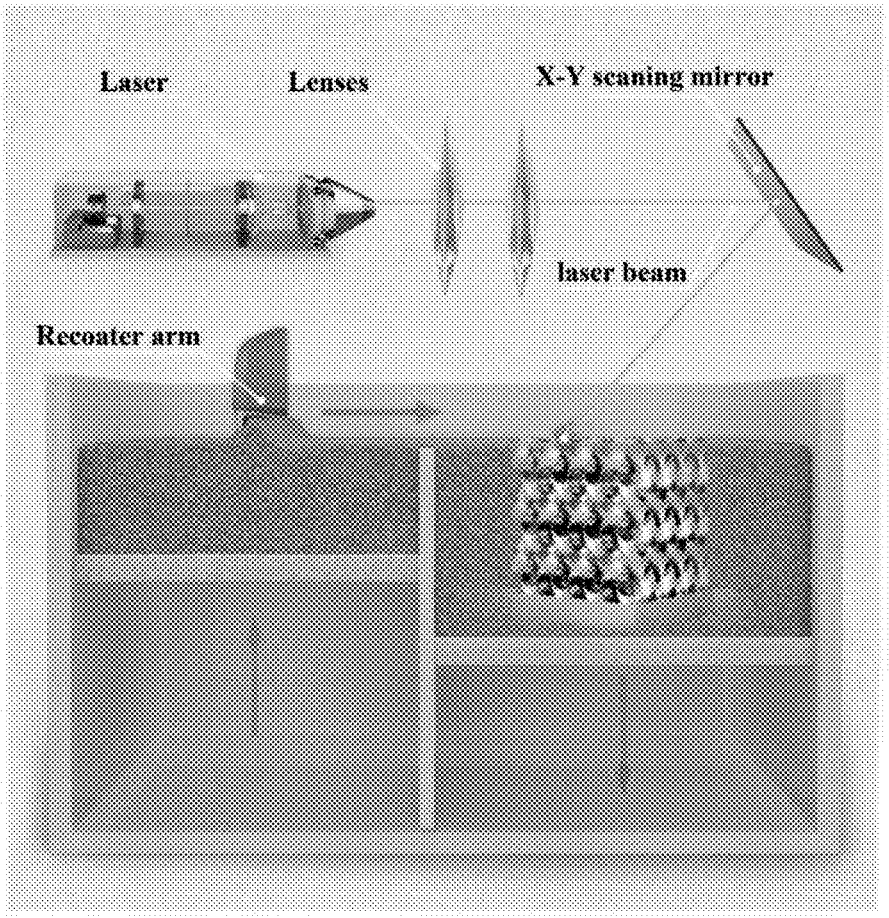
FIG. 1B shows a schematic of the SM technology.
Figure 1C:
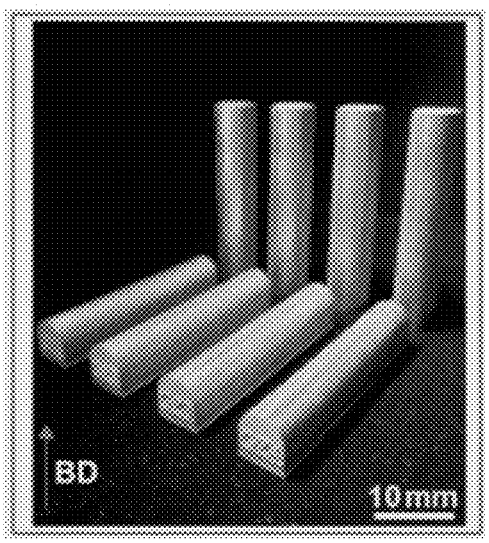
FIG. 1C shows 3D-printed rectangular NS-ASOs HEAs with a dimensions of 50 mm (length)×16 mm (width)×12 mm (height) and 50 mm (height)×16 mm (length)×12 mm (width).

Through preliminary experiments based on the normalized equivalent energy density, the parameters were optimized (Energy density of 64.59 J/mm$^3$, power of 285 W, scanning rate of 950 mm/s) for fabricating the cuboid samples using selective laser melting (SLM) (FIGS. 1B-1C, Table 1).

TABLE 1 the optimized processing parameters of laser-powder bed fusion (L-PBF)

| Processing parameters | |
|---|---|
| Laser power (W) | 270 |
| Scan speed (mm/s) | 950 |
| Layer thickness (μm) | 40 |
| Hatch spacing (μm) | 110 |
| Scan pattern | Layer to layer rotation |
| Rotation angle (°) | 67 |

Although cracks and voids were detected in the as-printed HEAs using microcomputed tomography (μ-CT) and metallographic methods (FIG. 1D and FIG. 2), it is almost entirely dense, with a relative density of 99.998%, surpassing even the reported excellent-printability titanium alloy (99.92%) (Table 2).

TABLE 2

Comparison of the relative density between the present NS-ASO HEA and other as-printed alloys reported in prior art

| | Alloy | AM method | Relative Density (%) | Detection method |
|---|---|---|---|---|
| This work | NS-ASO HEA | SLM | 99.998 | 3D CT |
| Superalloy | IN713LC | SLM | 99.92 | OM |
| | IN738LC | SLM | Cracked | OM |
| | GH4099 | SLM | 99.7 | OM |
| | CMSX-4 | SLM | Cracked | OM |
| | GH99 | SLM | 99.57 | OM |
| | Haynes282 | SLM | 99.98 | OM |
| | K418 | SLM | 99.7 | OM |
| | Rene77 | SLM | 99.93 | OM |
| | GH3536 | SLM | 99.91 | OM |
| | SB—CoNi—10C | SLM | 99.85 | OM |
| | CM247LC | SLM | Cracked | SEM |
| | IN939 | SLM | Cracked | SEM |
| | MAR M-247 | SLM | Cracked | SEM |
| | M3 | SLM | Cracked | SEM |
| | Rene 108 | SLM | Cracked | SEM |
| | Hastelloy X | SLM | 99.9 | Archimedes |
| | IN625 | SLM | 99.95 | Archimedes |
| | GTD222 | SLM | 99.8 | Archimedes |
| | GH5188 | SLM | 99.53 | Archimedes |
| HEA | $AlCoCrFeNi_{2.1}$ | SLM | 99.5 | — |
| | AlCrFeNiV | SLM | 99.88 | OM |
| | AlCrCuFeNix | SLM | 99.7 | OM |
| | FeNiCoAlTaB | SLM | 99.8 | OM |
| | $(FeCoNi)_{85.84}Al_{7.07}Ti_{7.09}$ | SLM | 99.95 | Archimedes |
| | $Al_{0.3}CoCrFeNiCu$ | SLM | 99.08 | Archimedes |
| | TiNbTaZrMo | SLM | 99.7 | Archimedes |
| | $(FeCoNi)_{86}Al_7Ti_7$ | SLM | 99.43 | Archimedes |
| | $Al_{0.2}Co_{1.5}CrFeNi_{1.5}Ti_{0.3}$ | SLM | 97 | OM+ Archimedes |
| | FeCoCrNi | SLM | 99.01 | Archimedes |
| | CoCrFeNiTi | SLM | 99.3 | Archimedes |
| | CoCrFeNiMn | SLM | 99.2 | Archimedes |
| | $Fe_{50}Mn_{30}Co_{10}Cr_{10}$ | SLM | 99.4 | Archimedes |
| | $NiCrFeCoMo_{0.2}$ | SLM | 99.12 | Archimedes |
| | $Co_{1.5}CrFeNi_{1.5}Ti_{0.5}Mo_{0.1}$ | SLM | 99.3 | Archimedes |
| | CoCrNi | SLM | 99.7 | 3D CT |
| Titanium alloy | Ti—1Al—8V—5Fe | SLM | 99.38 | OM |
| | Ti—35Nb—7Zr-—5Ta | SLM | 99.87 | OM |
| | Ti—6Al—2Sn—4Zr—2Mo | SLM | 99.5 | Archimedes |
| | Ti—6Al—2Zr—1Mo—1V | SLM | 99.5 | Archimedes |
| | Ti5.5Al—3.4Sn—3.0Zr—0.7Mo—0.3Si—0.4Nb—0.35Ta | SLM | 99.34 | Archimedes |
| | Ti15A | SLM | 99.98 | Archimedes |
| | TiTa | SLM | 99.9 | Archimedes |
| | Ti—5Al—5Mo—5V—3Cr—1Zr | SLM | 99.9 | Archimedes |
| Aluminium alloy | 2024Al | SLM | 97.5 | OM |
| | 7075Al | SLM | 99.5 | OM |
| | Al—Cu—Mg | SLM | 96.7 | OM |
| | Ti/Al—Cu—Mg | SLM | 99.7 | OM |
| | AlSi7Mg0.3 | SLM | 99.8 | Archimedes |
| | 7075Al | SLM | 97.2 | Archimedes |
| | A357 | SLM | 99.79 | Archimedes |
| | AlSi10Mg | SLM | 98.5 | Archimedes |
| | AA6061 | SLM | 97.6 | Archimedes |
| | AlSi12 | SLM | 99.97 | 3D CT |

Figure 1D:
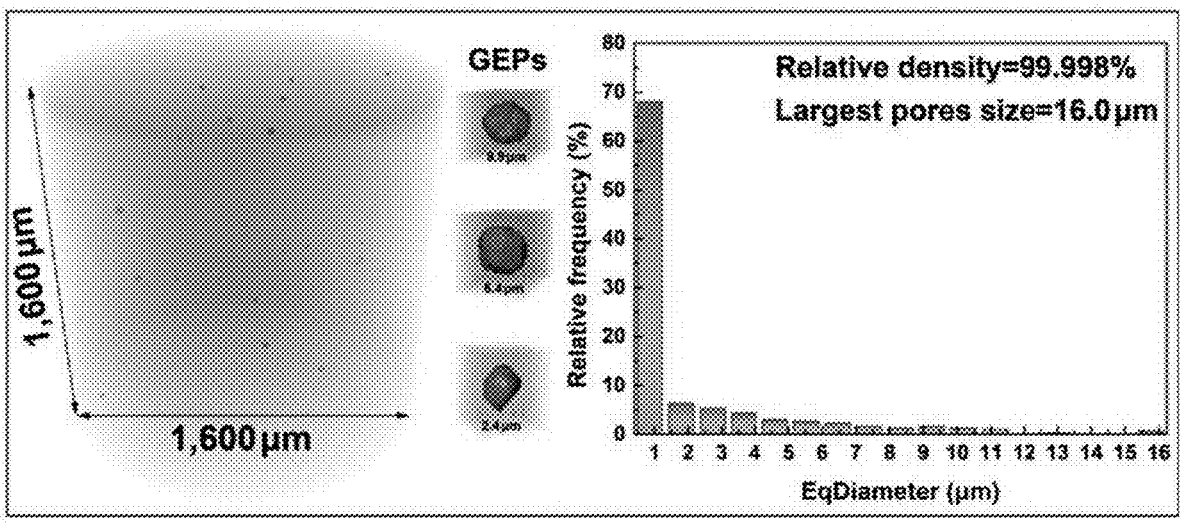
FIG. 1D presents μ-CT (0.5 μm) analyses showing the as-printed NS-ASO HEA is almost wholly dense, with a relative density of 99.998%. Extracted voids of three different sizes (on the right) show mainly gas-entrapped pores (GEPs), and the EqDiameter-relative frequency diagram shows the GEPs are smaller than about 2 μm account for about 75%, and the largest GEP size is smaller about 16 μm.
Figure 2:
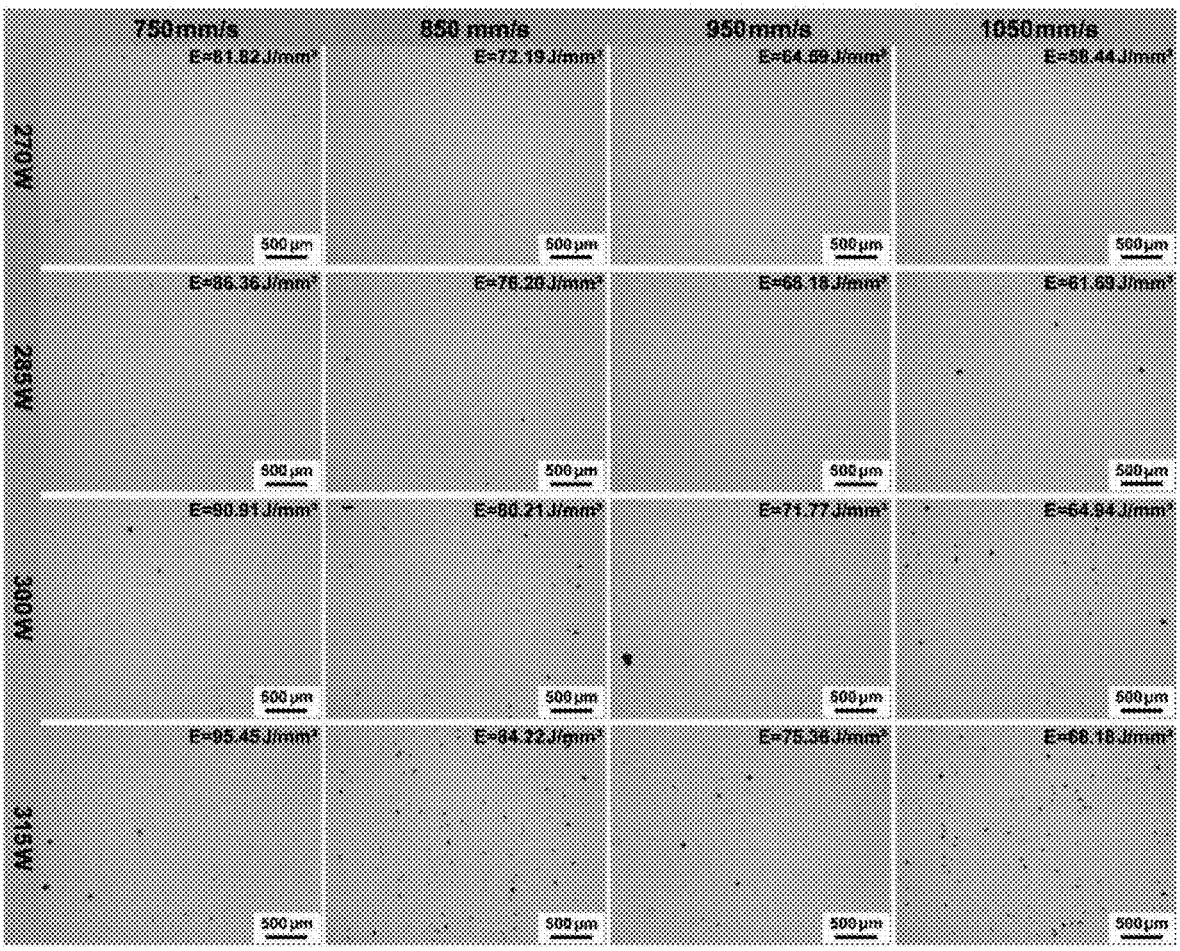
FIG. 2 shows metallographic images of the as-printed NS-ASO HEA fabricated using different processing parameters.

The present invention further addresses common defects encountered during the 3D printing process, such as lack of fusion (LoF) defects and the occurrence of keyholes. LoFs refer to the situation where materials in the 3D printing process do not fully fuse together to form a continuous structure. This can lead to poor adhesion between material layers, impacting the overall strength and performance of the printed object. Keyholes, on the other hand, are holes formed during the 3D printing process due to excessive printing speed or improper material flow. These holes typically have a keyhole shape and may affect the appearance and surface quality of the printed object. Referring to FIG. 1D, only gas-entrapped pores (GEPs) defects were observed in the printed samples, with no instances of cracks, common lack of fusion (LoF) defects, or keyholes (KHs) present.

These results indicates that the multi-component high entropy alloy with NS-ASO structure (NS-ASO HEAs) effectively resolved the typical cracking problems typically associated with precipitate-strengthened superalloys containing FCC and $L1_2$ with (Al+Ti+Nb+Ta)>6.0 wt. %.

Figure 3:
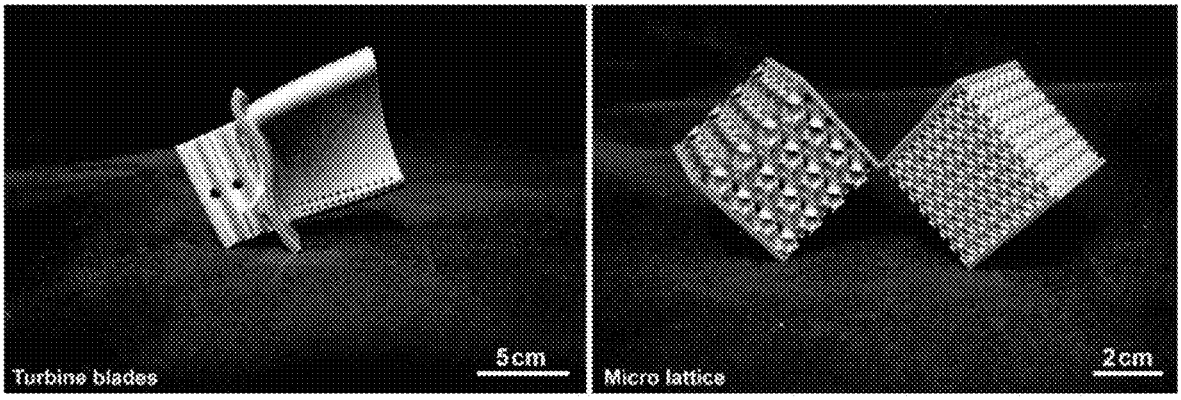
FIG. 3 shows photographs of printed turbine blades and micro lattice.

Furthermore, representative engineering components such as an octet-truss micro lattice and prototype turbine blades with thin, overhanging platforms were successfully printed (FIG. 3). This further confirms the excellent printability of this HEA.

Figure 1E:
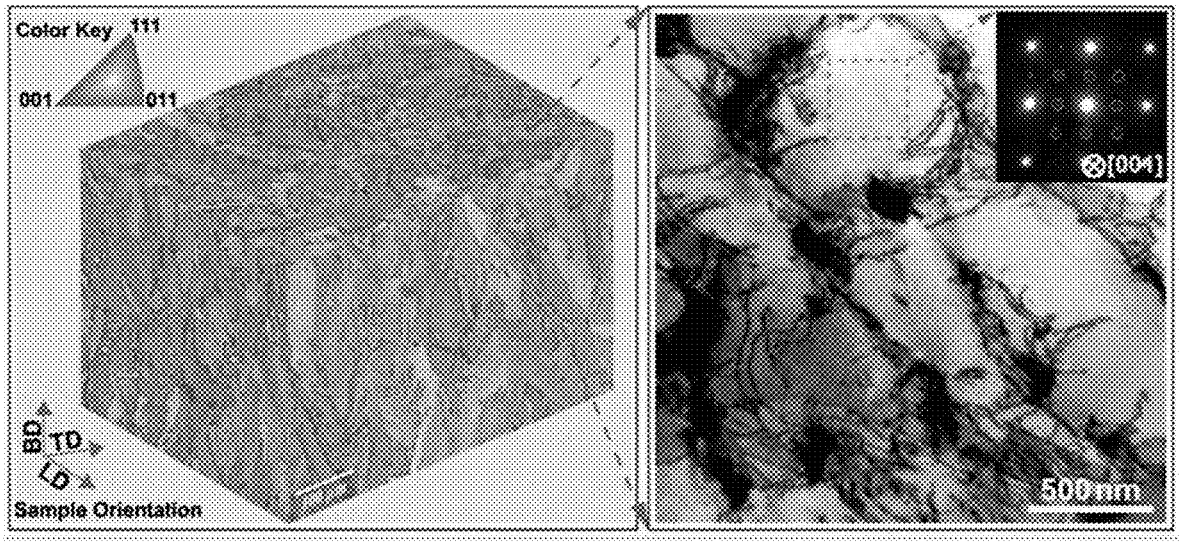
FIG. 1E shows IPF maps acquired through EBSD showing the grain structure of the as-printed NS-ASO HEAs along three-dimensional directions (the building direction (BD), transverse direction (TD), and loading direction (LD)). The insert features a bright-field (BF) TEM image showcasing the dislocation cell structure, alongside a corresponding selected-area electron diffraction pattern collected from the dislocation cell interior, revealing a globally ordered structure.
Figure 1F:
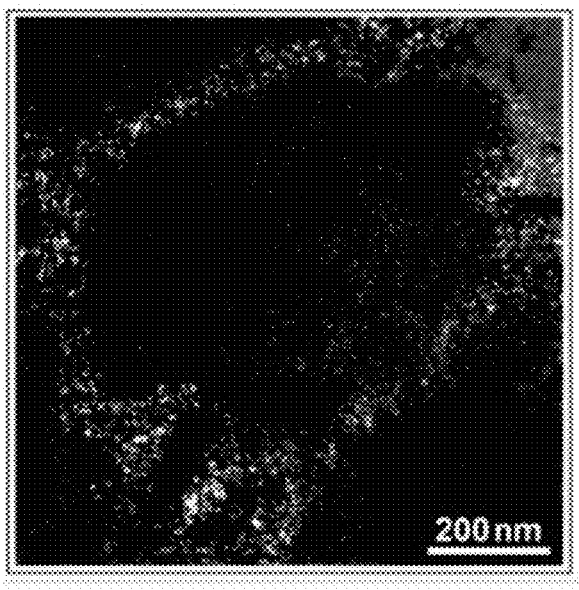
FIG. 1F shows a dark-field image corresponding to the superlattice spots.
Figure 4A:
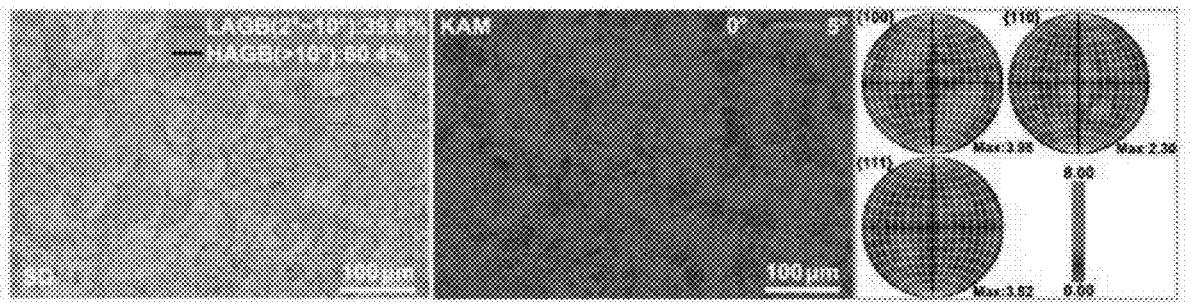
FIG. 4A shows the IPF image. Image quality (IQ) map with high-angle grain boundaries (HAGBs) and low-angle grain boundaries (LAGBs) superimposed, and the normalised pole figures of FCC {10, {110}, and {111} in BD.
Figure 4B:
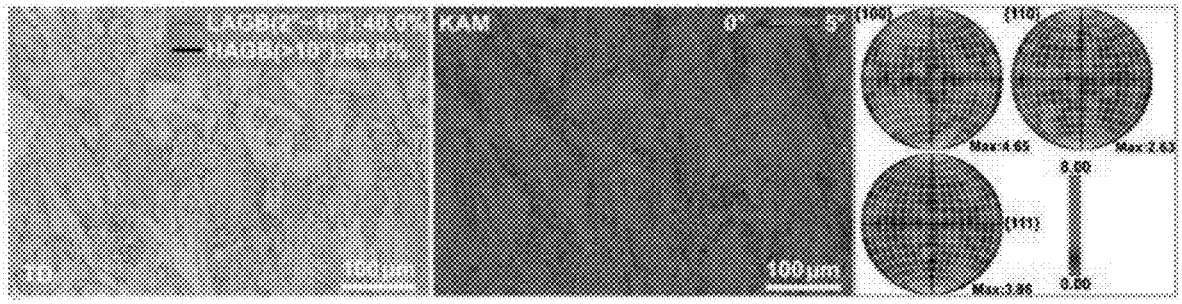
FIG. 4B shows the IPF image. Image quality (IQ) map with HAGBs and LAGBs superimposed, and the normalised pole figures of FCC {100}, {110}, and {111} in TD.
Figure 4C:
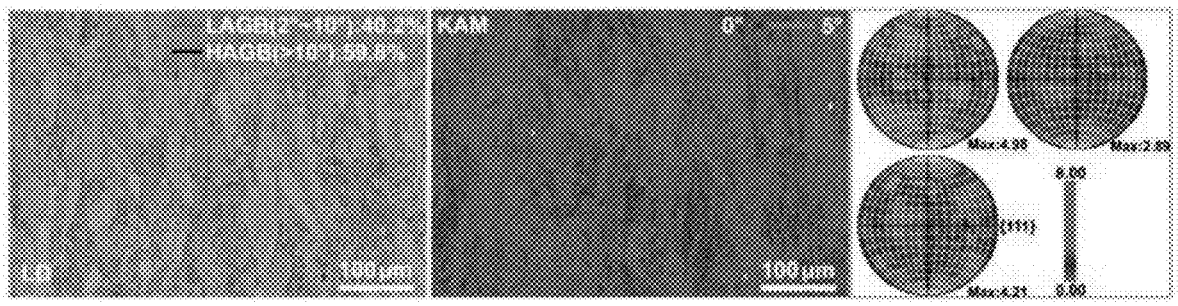
FIG. 4C shows the IPF image. Image quality (IQ) map with HAGBs and LAGBs superimposed, and the normalised pole figures of FCC {100}. {110}, and {111} in LD.

Following that, the basic microstructure of the as-printed NS-ASO HEAs was analyzed. The as-printed HEAs exhibited a polycrystalline morphology under EBSD, with no significant texture observed (FIG. 1E). The EBSD measurements further indicate that as-printed NS-ASO HEAs had a considerable proportion (40%) of low-angle grain boundaries (LAGBs, 2°-10°, FIGS. 4A-4C). Transmission electron microscopy (TEM) image revealed an intriguing structural characteristic of the grains, each composed of the sub-micron-scale (approximately 600 nm) dislocation cell. Furthermore, selected area electron diffraction (SAED) pattern taken along the [110] Fcc zone axis displayed superlattice spots, confirming the high degree of chemical ordering nature (insert in FIG. 1E). Moreover, the dark field (DF) TEM image highlighted the presence of in-situ nanoscale self-ordering domain with a high density and uniform intragranular distribution (FIG. 1F).

Example 2

Atomic-Scale Chemical Composition of the Printed HEAs

Figure 5A:
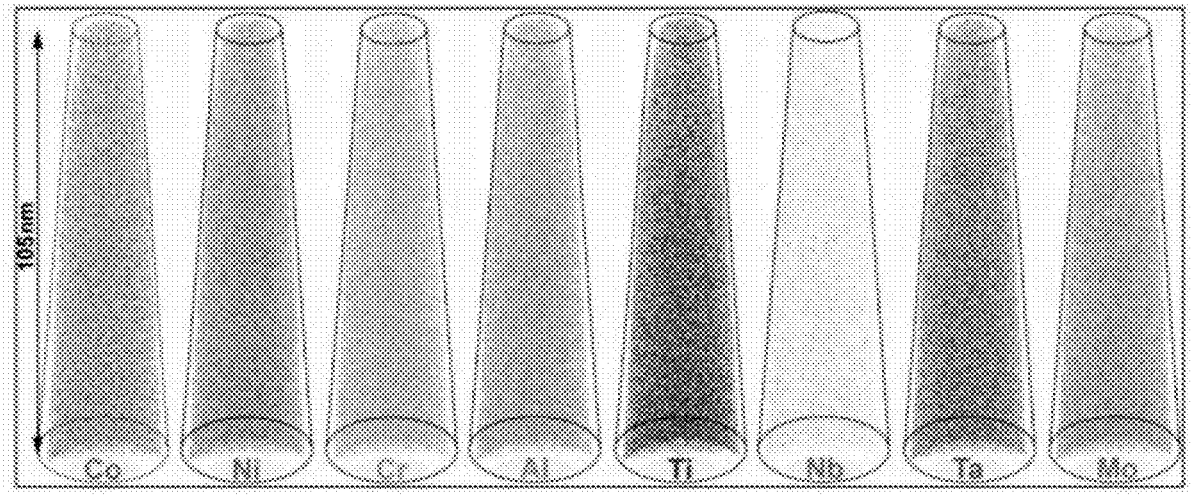
FIG. 5A shows atom maps showing the uniform distribution of Co, Ni, Al, Cr, Ti, Nb, Ta, and Mo elements; the size of the black ruler is 10 nm.

In this example, three-dimensional atom probe tomography (3D-APT, spatial resolution of approximately 1 nm) was used to evaluate the atomic-scale chemical composition of our as-printed HEAs. Turning to FIG. 5A, the composition was discovered to be uniform, showing no signs of elemental clustering within the dislocation cells.

Figure 5B:
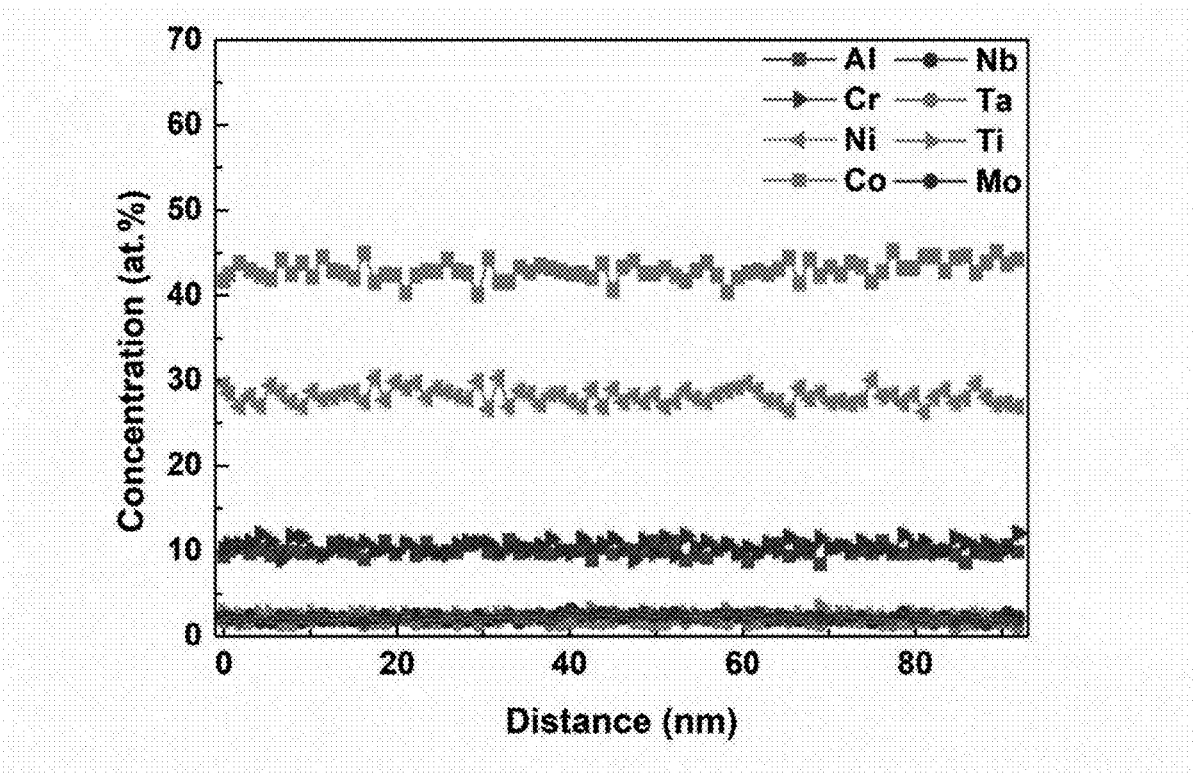
FIG. 5B shows one-dimensional (1D) compositional profile revealing the elemental distributions in the dislocation cell.

Referring to FIG. 5B, the one-dimensional (1D) compositional profile disclosed the quantitative elemental partitioning of each element, indicating smooth curves for all elements without any indication of segregation. The concentration closely corresponded to the nominal composition of the investigated HEAs as shown in Table 3.

TABLE 3

Chemical compositions of the present NS-ASO HEA measured by 3D-APT

| | Co | Ni | Al | Cr | Ti | Nb | Ta | Mo |
|---|---|---|---|---|---|---|---|---|
| DC1 | 43.48 ± 1.62 | 30.16 ± 1.24 | 10.09 ± 0.80 | 10.55 ± 0.81 | 1.64 ± 0.39 | 1.43 ± 0.13 | 1.91 ± 0.40 | 2.00 ± 0.98 |
| DC2 | 43.99 ± 2.04 | 27.52 ± 1.54 | 10.17 ± 1.02 | 10.43 ± 1.03 | 2.20 ± 0.61 | 2.05 ± 0.53 | 1.74 ± 0.46 | 2.21 ± 1.00 |
| DC3 | 43.09 ± 2.08 | 29.57 ± 1.72 | 10.37 ± 1.17 | 11.03 ± 1.18 | 1.72 ± 0.52 | 1.94 ± 0.42 | 1.95 ± 0.55 | 2.07 ± 0.18 |
| DC4 | 43.23 ± 2.16 | 27.91 ± 0.48 | 10.21 ± 0.89 | 10.96 ± 0.48 | 1.64 ± 0.21 | 2.06 ± 0.23 | 1.90 ± 0.25 | 2.07 ± 0.23 |

Figure 5C:
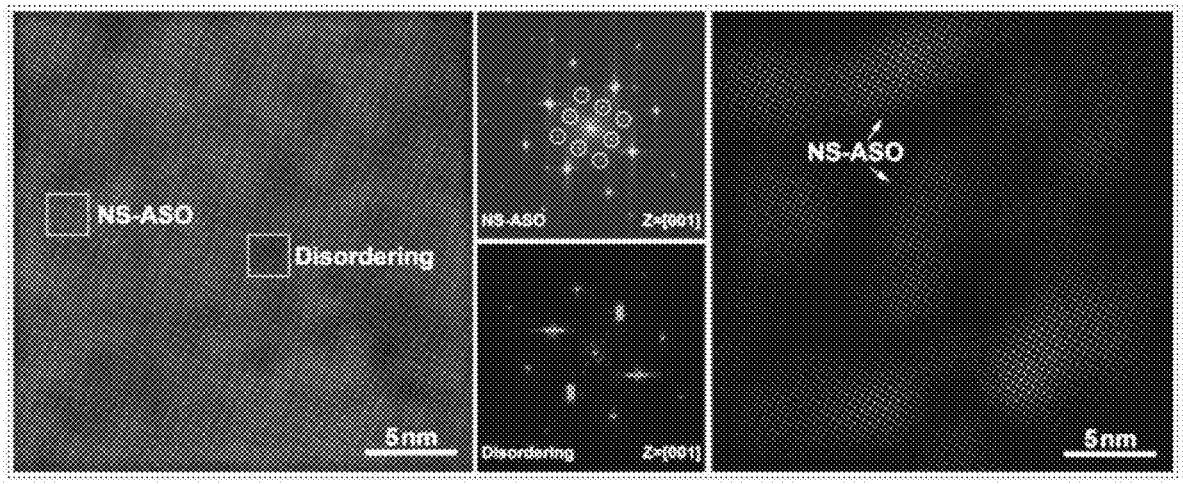
FIG. 5C shows a high-resolution transmission electron microscopy (HR-TEM) image. The fast Fourier transform (FFT) patterns reveal that the NS-ASO structure and disordered structure, while the inverse fast Fourier transform (IFFT) from the superlattice lattice further demonstrates the NS-ASO structure.
Figure 5D:
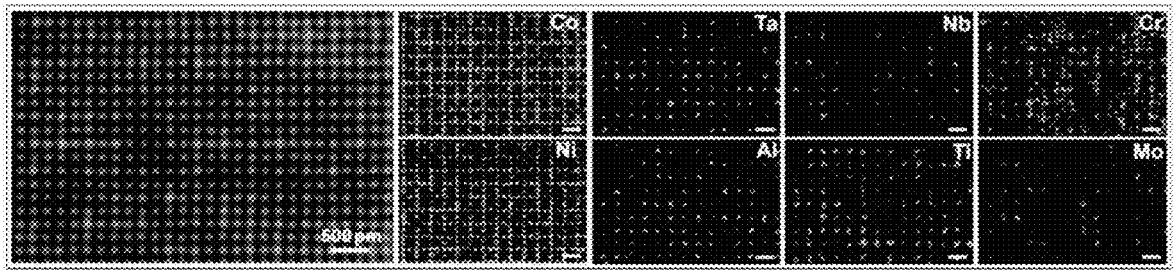
FIG. 5D shows an atomic-resolution HAADF-STEM image and corresponding energy-dispersive X-ray spectroscopy (EDX) mappings taken from the NS-ASO structure, revealing the sublattice occupations.
Figure 6A:
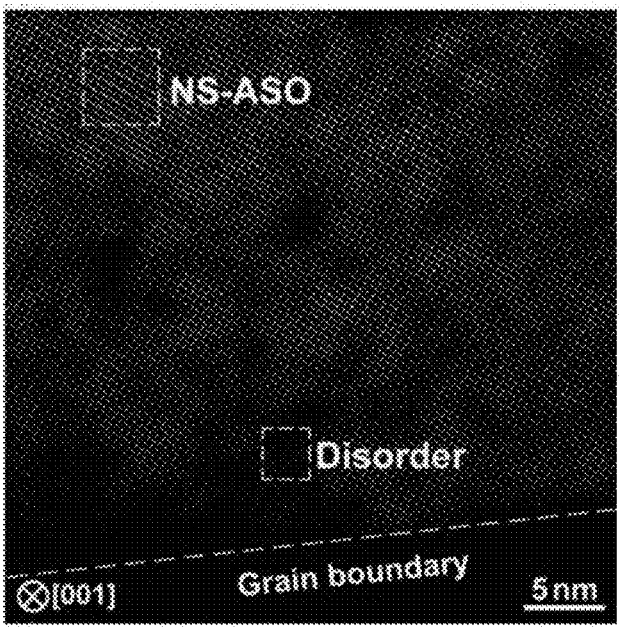
FIG. 6A shows a HAADF-STEM image captured along the zone axis.
Figure 6B:
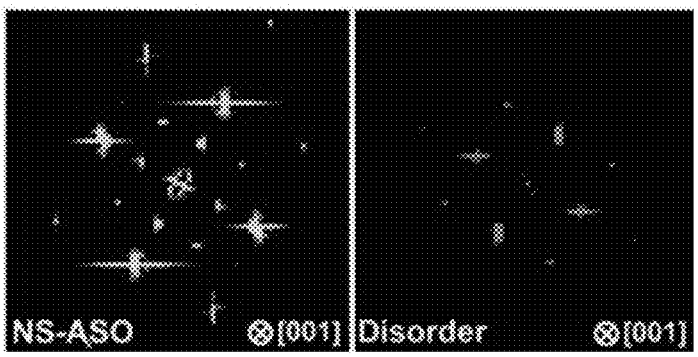
FIG. 6B shows corresponding FFT images showing both the NS-ASO and disordered structures.
Figure 6C:
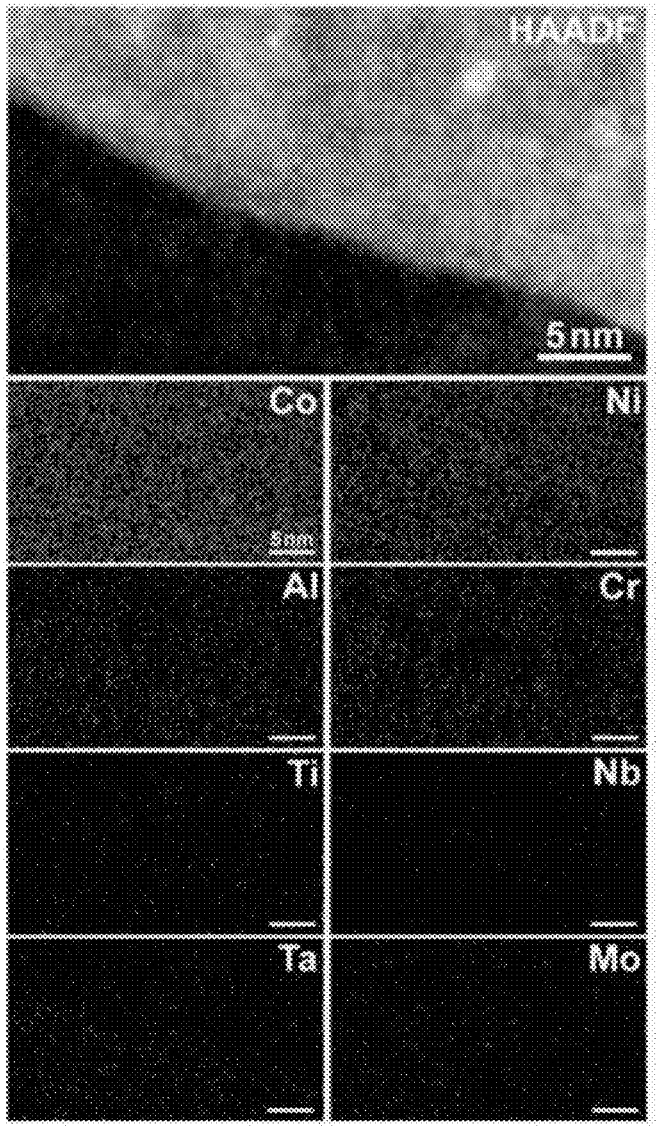
FIG. 6C shows HAADF and EDS-mapping performed on regions encompassing the grain boundaries, confirming the absence of elemental segregation at the grain boundary.

Turning to FIGS. 5C-5D, additional atomic structure and compositional details were investigated using atomic resolution high-angle annular dark-field scanning transmission electron microscopy (HAADF-STEM). HAADF-STEM and fast Fourier transform (FFT) analyses revealed that the dislocation cells exhibited an in-situ nanoscale order-disorder structure. In FIG. 2C, the volume fraction was derived from statistical analysis of TEM images using ImageJ software. These NS-ASO structures, with dimensions ranging from 3-5 nm, had a volume fraction of approximately 44%. FIG. 5D showed that, through atomic-resolution energy-dispersive X-ray spectroscopy (EDX) mapping along the zone axis, that Ti, Al, Nb, Ta, and Mo atoms predominantly occupied the B sublattice (vertices) of the $L1_2$ unit cell, whereas the A sublattices (the face centers) were occupied by Co and Ni elements. The presence of Cr elements was observed in both sublattice sites of the $L1_2$ unit cell, contributing to the alloy's stoichiometry. With the aid of HAADF-STEM, it was observed that the NS-ASO structures were perfectly coherent with the matrix (FIG. 5C). The coherent NA-ASO structures were also observed in the vicinity of the grain boundary, with no elemental segregation at these grain boundaries (FIGS. 6A-6C).

Figure 7A:
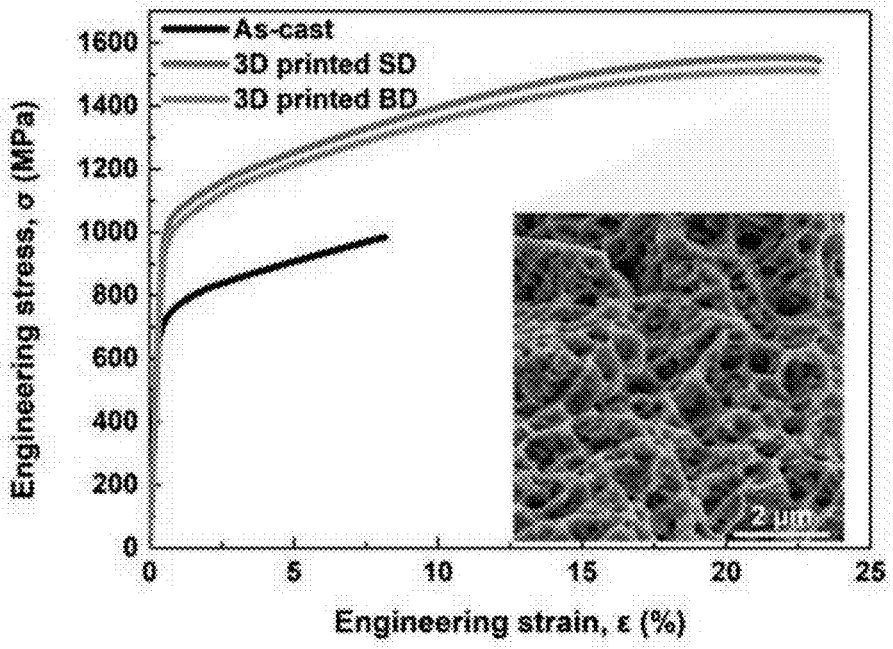
FIG. 7A depicts a tensile stress-strain curve of the as-printed HEA in both the scanning direction (SD) and the building direction (BD), as well as the as-cast HEA tested at ambient temperature. The insert presents tensile fractography showing the ductile dimpled structures.
Figure 7B:
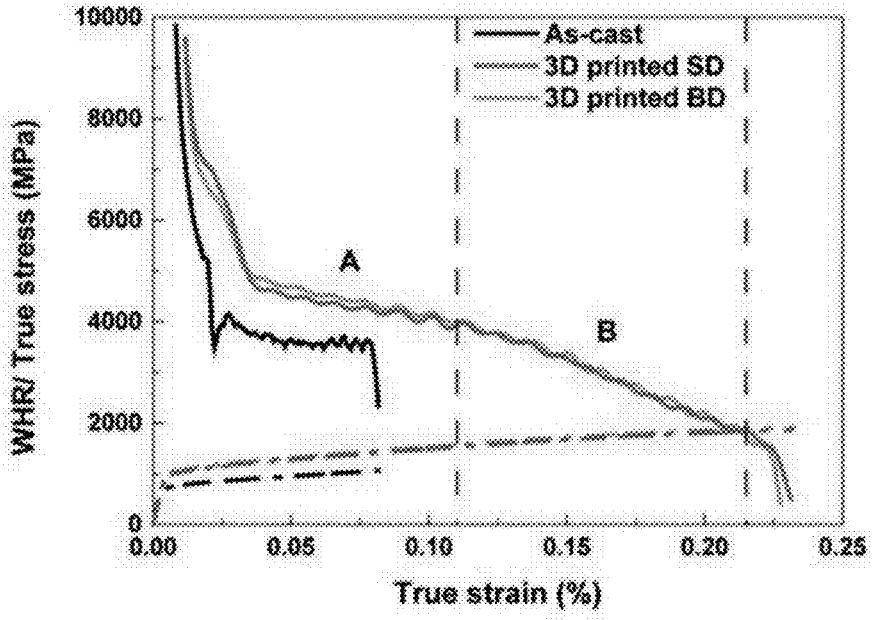
FIG. 7B depicts the work hardening rate (WHR) versus true strain curves and true stress-strain curves of copper-mould-cast, SD, and BD samples.
Figure 8:
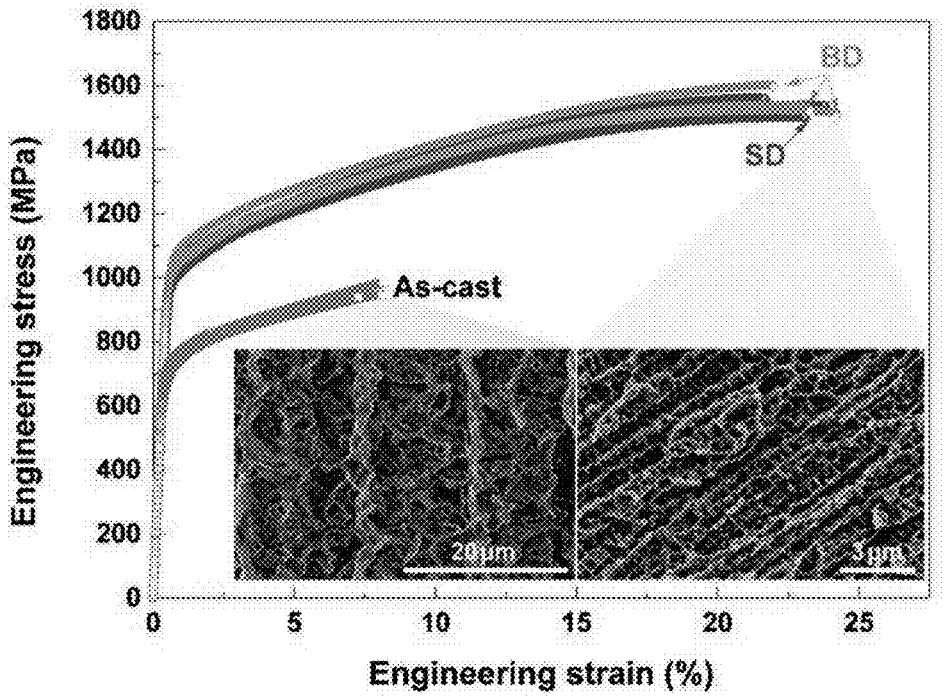
FIG. 8 shows tensile properties and work-hardening behaviors of both as-printed NS-ASO and copper-mould-cast HEA. Engineering stress-strain curves tested at ambient temperature in air. The inset gives tensile fracture morphologies of copper-mould-cast and SD samples.

The main issue with as-printed precipitate-hardened alloys lies in the balance between strength and ductility, alongside the anisotropic mechanical properties observed in both building direction (BD) and scanning direction (SD). FIG. 7A showed the engineering stress-strain curves of the as-printed NS-ASO HEAs and the copper-mould-cast HEA at ambient temperature. The NS-ASO HEAs demonstrated an exceptional synergy of strength and ductility, characterized by an unexpectedly high yield strength (σy) of approximately 1.01 GPa and a significant uniform elongation of approximately 22.5%. The uniform elongation is highlighted in the normalized strain-hardening curve (FIG. 8). Furthermore, the as-printed NS-ASO HEAs exhibited a superb work-hardening ability (Outs-Oy=approximately 530 MPa, $\sigma_y/\sigma_{uts}$=0.67), even at elevated yield strength in the post-yield region. This attribute contributes to a high ultimate tensile strength (Guts) of about 1.54 GPa (FIG. 7B). Significantly, both the ultimate tensile strength (Outs) and the uniform elongation were 1.7 and 3.2 times greater, respectively, than those of the as-cast counterpart. Additionally, the fracture surface, characterized by numerous dimpled structures (inset in FIG. 7A), further confirms the inherently ductile nature and plastic deformability.

Figure 9:
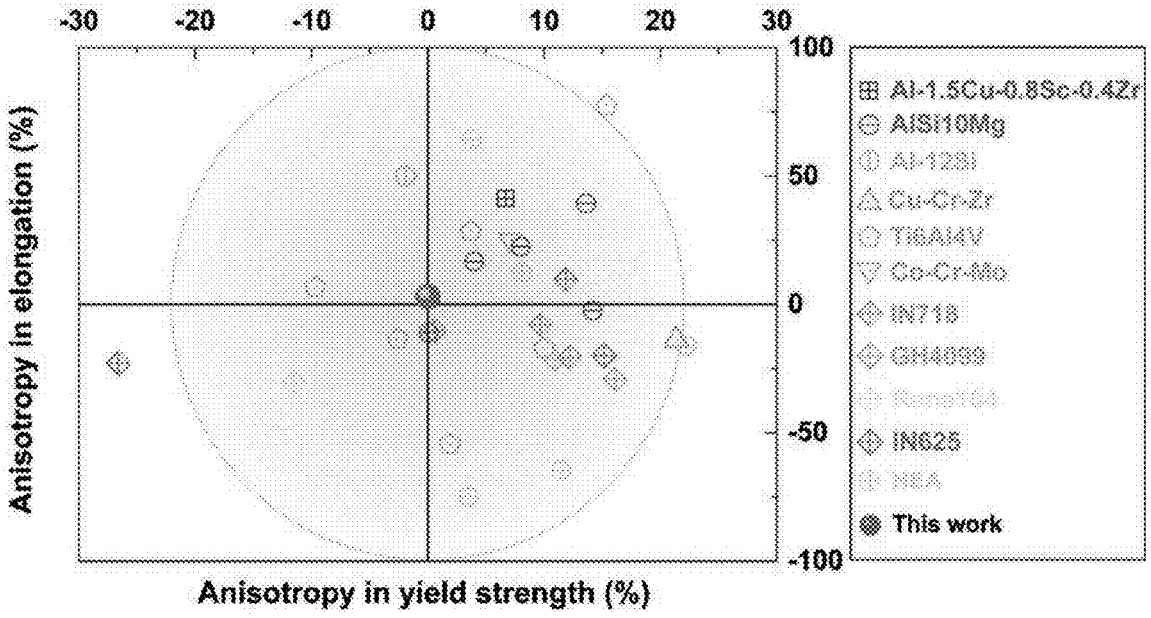
FIG. 9 shows anisotropy in oy versus anisotropy in elongation of the as-printed NS-ASO HEA compared with other as-printed alloys. The anisotropy was defined as [($\sigma_x$−

Referring to FIG. 9, the as-printed NS-ASO HEAs exhibited remarkable strength-ductility isotropy in both the SD and BD, which stands in stark contrast to the as-printed Ti-6Al-4V alloy, aluminum alloy, copper alloy, superalloy, and other HEAs, etc. This isotropy is crucial for reliability in engineering applications.

Figure 7C:
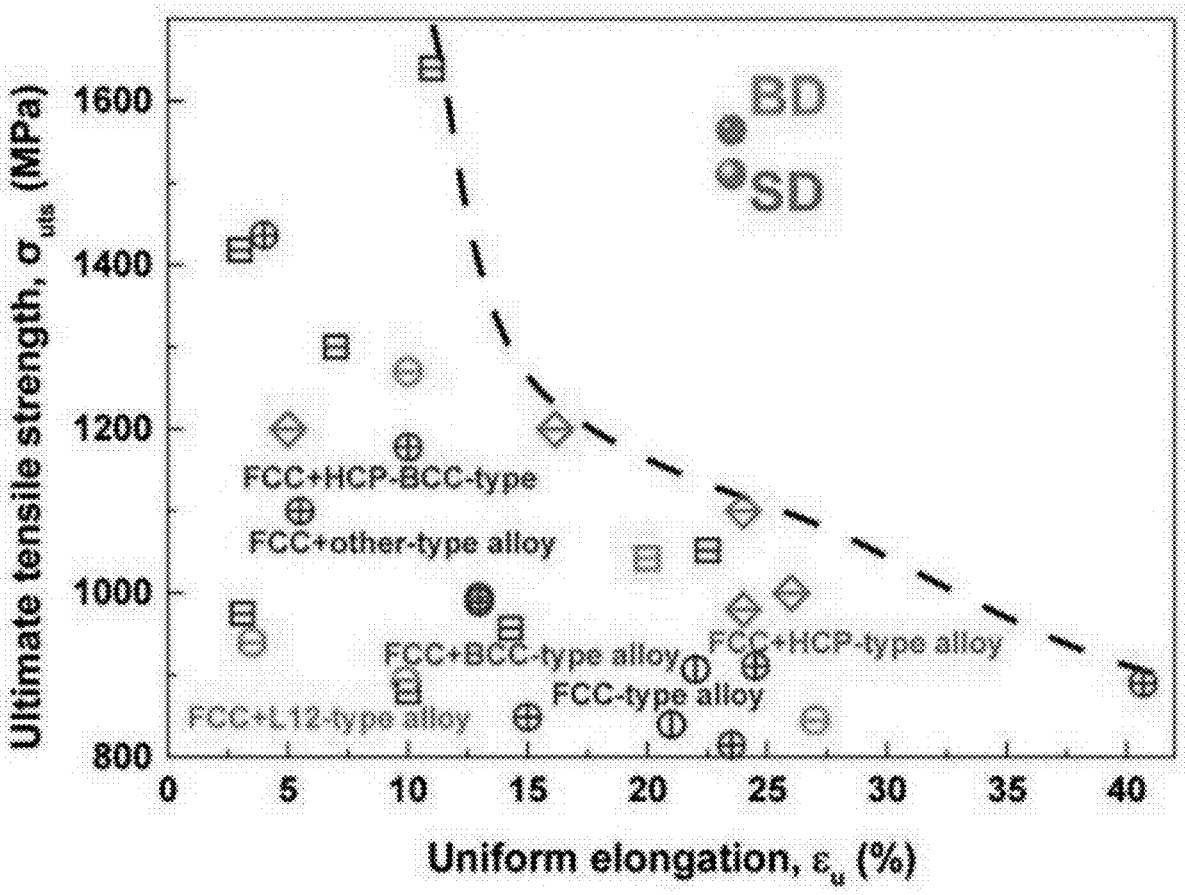
FIG. 7C depicts the ultimate tensile strength (Outs) versus uniform elongation (Eu) of the present as-printed NS-ASO HEA compared with other as-printed alloys with various structure.

Additionally, Outs versus uniform elongation curves were plotted and compared with those of as-printed alloys featuring FCC-type, FCC+BCC-type, FCC+$L1_2$-type, FCC+HCP-type, FCC+BCC+HCP-type, and FCC+ other structures (i.e., carbides, ceramic, etc.)-type alloys. The results illustrated the exceptional combination of high strength and large ductility exhibited by the NS-ASO HEAs of the present invention, surpassing those of state-of-the-art as-printed alloys (FIG. 7C and Table 4).

TABLE 4

Room temperature tensile properties of other as-printed alloys reported in prior art

| Materials | | $\sigma_{uts}$ (MPa) | Uniform elongation (%) |
|---|---|---|---|
| Ti—3.5Cu | LMD | 1180 | 2.1 |
| Ti—6.5Cu | | 1073 | 5.5 |
| Ti—8.5Cu | | 867 | 10.5 |
| Ti64—4.5%316L | SLM | 1297 | 8.8 |
| Ti—6Al-4V | SLM with ultrasound | 1137 | 3.0 |

TABLE 4-continued

Room temperature tensile properties of other as-printed alloys reported in prior art

| Materials | | $\sigma_{uts}$ (MPa) | Uniform elongation (%) |
|---|---|---|---|
| | SLM without ultrasound | 1015 | 3.7 |
| Ti—6Al—4V | SLM-V | 1219 | 1.9 |
| | SLM-H | 1269 | 2.0 |
| Ti—6Al—4V | SLM-V | 1166 | 1.7 |
| | SLM-H | 1206 | 2.6 |
| Ti—6Al—4V | SLM | 1300 | 3.0 |
| | | 1272 | 3.3 |
| | | 1252 | 3.4 |
| | | 1150 | 3.5 |
| | | 1028 | 6.3 |
| Ti—6Al—4V | SLM | 1115 | 2.5 |
| Ti—6Al—4V | SLM | 1095 | 4.5 |
| Ti—6Al—4V | SLM | 1090 | 4.5 |
| | | 1149 | 5.4 |
| | | 1165 | 5.2 |
| CoCrNi | LAAM | 873.5 | 43 |
| $Fe_{26.13}Co_{23.1}Ni_{23.29}Cr_{25.78}Si_{1.36}C_{0.34}$ | SLM | 907 | 22 |
| $(CoCrFeMnNi)_{99}C_1$ | SLM | 840 | 21 |
| $Al_{0.5}Cr_{0.9}FeNi_{2.5}V_{0.2}$ | SLM | 1057 | 27 |
| $Co_{32.4}Ni_{11.7}W_{4.4}Cr_{3.3}Ta_{1.5}$ | SLM | 1270 | 11.5 |
| $AlCoCrFeNi_{2.1}$ | SLM | 1418 | 3.19 |
| $AlCrCuFeNi_{3.0}$ | SLM | 957 | 14.3 |
| AlCoCrFeNi | CCW-AAM | 975 | 3.11 |
| $Al_{0.25}FeMnNiCrCu_{0.5}$ | LMD | 1052 | 24.5 |
| $Al_{36.67}Ni_{33.79}Fe_{17.28}Cr_{8.28}Co_{4.99}$ | WAAM | 880 | 10 |
| $AlCoCrFeNi_{2.1}$ | SLM | 1640 | 7.5 |
| $Fe_{49.5}Mn_{30}Co_{10}Cr_{10}C_{0.5}$ | SLM | 1000 | 28 |
| $Fe_{40}Mn_{20}Co_{20}Cr_{15}Si_5$ | L-PBF | 980 | 24 |
| $Fe_{40}Mn_{20}Co_{20}Cr_{15}Si_5$—$B_4C$ | | 1200 | 5 |
| $Al_{0.2}Co_{1.5}CrFeNi_{1.5}Ti_{0.3}$ | SLM | 1042 | 20.58 |
| $(FeCoNi)_{86}Al_7Ti_7$ | SLM | 1090 | 28 |
| $Co_{1.5}CrFeNi_{1.5}Ti_{0.5}Mo_{0.1}$ | SLM | 1178 | 20 |
| $Co_{19.96}Cr_{20.31}Fe_{20.18}Ni_{20.07}Mn_{19.48}$ + TiN(12 wt. %) | SLM | 1100 | 5.5 |
| $(CoCrFeMnNi)_{99}C_1$ | SLM | 989 | 11 |
| $(FeCoCrNi)_{98.5}Si_{1.5}$ | SLM | 815 | 23.5 |
| $(CoCrFeMnNi)_{99}C_1$ | SLM | 995 | 13 |
| $Ni_{20.7}Cr_{19.8}Mn_{18.7}Co_{20.9}Fe_{19.9}$ + 1 wt. % | L-PBF | 940 | 30 |
| AlCoCrFeNi2.1 | SLM | 1600 | 10 |
| $AlCoCrFeNi_{2.1}$ | LMD | 965 | 12.5 |
| | | 1100 | 21 |
| Al1.2CoCrFeNi$_{2.1}$ | PPA-AM | 985 | 6 |
| $Ni_6Cr_4WFe_9Ti$ | SLM | 966 | 11 |
| $Al_{0.5}CrCoFeNi$ | SLM | 865 | 16 |
| $FeCoCrNiMo_{0.3}$ | L-PBF | 955 | 36 |
| $AlCoCrFeNi_{2.1}$ | SLM | 1260 | 21 |
| | | 1280 | 20 |
| | | 1355 | 8.5 |
| | | 1441 | 5 |
| | | 1489 | 4.8 |
| $(FeCoNi)_{86}Al_7Ti_7$ | SLM | 1010 | 18.5 |
| VCoNi | LMD | 1219 | 19 |
| | | 1354 | 14.8 |
| | | 1463 | 11 |
| | | 1539 | 9 |
| EP718 | SLM | 845 | 27 |
| MM509 | SLM | 1436 | 4.3 |
| K468 | EHLMD | 880 | 30 |
| Hastelloy X | SLM | 935 | 13 |
| IN100 | Micro-LAAM | 1030 | 9 |
| Inconel718 | SLM | 1033 | 25 |
| Inconel718 | SLM | 947 | 17 |
| Inconel718 | EBM | 908 | 12.4 |
| | SLM | 1026 | 20 |
| Inconel738 | SLM | 1592 | 6 |
| | | 1290 | 11.3 |
| Inconel625 | Additive | 1072 | 21 |

TABLE 4-continued

Room temperature tensile properties of other as-printed alloys reported in prior art

| Materials | | $\sigma_{uts}$ (MPa) | Uniform elongation (%) |
|---|---|---|---|
| | Friction Stir | | |
| Inconel625 | SLM | 835 | 40 |
| Inconel625 | SLM | 1041 | 33.1 |
| Inconel625 | PMAM | 834 | 17 |
| | | 855 | 31 |
| CMSX-4 | EBM | 930 | 5 |
| Hastelloy X + TiC | SLM | 849 | 15 |
| IN738LC | EBM | 1185 | 11.5 |
| | | 1074 | 9.5 |
| GH3536 | LSF | 855 | 18 |
| $Ni_{50.34}(Co, Cr)_{20}(Al, Ti)_{20}(Hf, Mo, Nb)_{9.2}(Si, C)_{0.46}$ | DED | 1096 | 24 |
| Co—28Cr—6Mo | SLM | 1260 | 12.7 |
| $Fe_{19}Ni_5Ti$ steel | DED | 1300 | 7 |
| AISI4340-H | SLM | 1510 | 4.5 |
| AISI4340-V | | 1474 | 4.8 |
| AISI8620-H | | 1400 | 3.0 |
| AISI8620-V | | 1384 | 4.3 |
| AISI4140-H | | 1110 | 2.5 |
| AISI4140-V | | 1080 | 2.2 |
| AISI 420 | LAAM | 1573 | 10 |
| 300M | SLM-V | 1218 | 8 |
| | SLM-H | 1119 | 8.4 |
| 15-5PH | SLM | 1413 | 21 |
| 15-5 PH | SLM | 1424 | 7.1 |
| 18Ni-300 | SLM-H | 1224 | 6 |
| | SLM-V | 1194 | 4 |
| 18Ni-300 | SLM-V | 1007 | 4 |
| | SLM-H | 1005 | 2 |
| ER120S-G | CMT-WAAM-H | 1000 | 8.8 |
| | CMT-WAAM-V | 1040 | 6.3 |
| SS411 | SLM-H | 892 | 9.5 |
| | SLM-V | 864 | 10.5 |

Figure 7D:
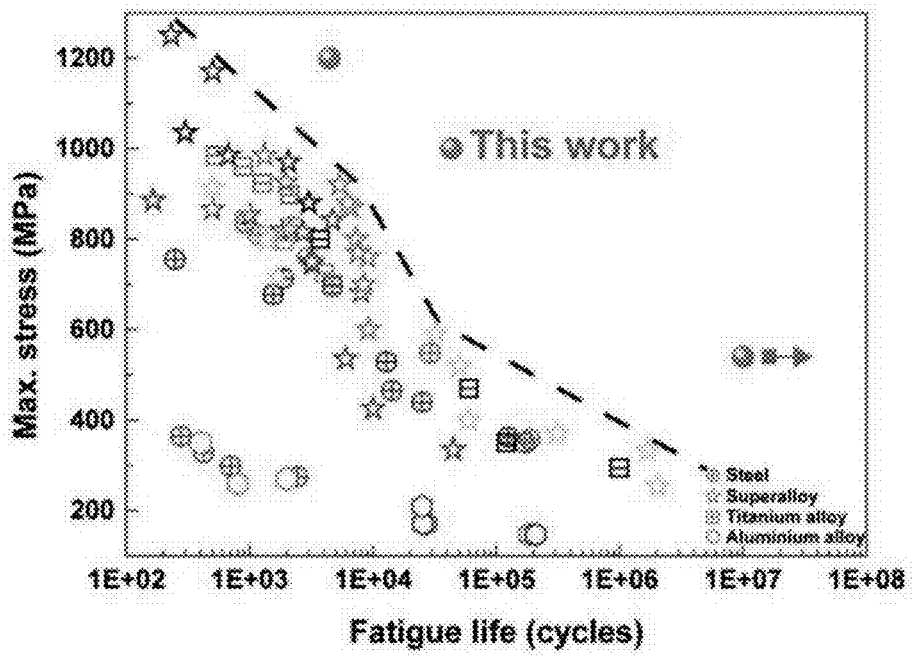
FIG. 7D depicts number of cycles of failure plotted against the maximum stress of the as-printed NS-ASO HEA (stress ratio (R)=−1.0), compared with other reported as-printed alloys.

In addition to the mechanical properties, the low cyclic fatigue (LCF) resistance of the present as-printed NS-ASO HEA was also evaluated, as shown in FIG. 7D. Further comparison of the LCF resistance of the as-printed NS-ASO HEA with other reported as-printed alloys reveals that the NS-ASO HEA demonstrated significantly longer fatigue life than other reported materials within the 400 to 1200 MPa maximum stress amplitude range.

An in-depth investigation of the compositional features and atomic structure of the HEA powders was initiated using APT and HAADF-STEM. FIGS. 10A-10C and 11A-11B revealed that the HEA powders also manifested cellular structures characterized by a homogenous elemental distribution. The HAADF-STEM findings elucidated that theses cellular formations were comprised of nanoscale structures, exhibiting both ordered and disordered arrangements. It was proven that these nanoscale coherent ordered structures in the HEAs originated from a self-assembly process during rapid-cooling solidification, inheriting features from the powder. Remarkably, these fully coherent NA-ASO structures appear to mitigate the stress relief typically induced by extreme cooling rate inherent in 3D printing processes, thereby potentially inhibit the cracking.

Additionally, Scheil-Gulliver analysis was employed to model the non-equilibrium solidification process, and Differential Scanning calorimetry (DSC) was utilized for enhanced insights (FIG. 12). Expanding upon this, the Cracking Susceptibility Index (CSI), was computed to assess the hot cracking resistance at the final stages of solidification:

$$CSI = \frac{d(T)}{d(f_s^{1/2})}$$

where $f_s$ is the fraction solid, and T is the temperature.

The HEA exhibited a smaller Scheil freezing range of about 240 K and a CSI value, even lower than readily printable IN718 and IN625 superalloys. STEM-EDS results showed there were no elemental segregation at the grain boundary and formation of FCC+$L1_2$ eutectic phases with low-melting point (FIGS. 6A-6C).

Additionally, the TEM and EDS results presented in FIG. 13A-13D and Table 5 showed that the HCP $Ni_3Nb$-type and BCC $Ni_2AlNb$-type precipitates in the powders served as low-energy-barrier heterogeneous nucleation sites ahead of the solidification front. This decreased the critical amount of undercooling needed to induce equiaxed growth, resulting in the formation of short columnar or near-equiaxed microstructure. Such microstructures more easily accommodate the strain in the semi-solid state compared to long columnar microstructures. All these ensured the excellent printable of the HEAs.

TABLE 5

Chemical compositions of the BCC and HCP phases precipitated in the NS-ASO HEA measured by STEM-EDS

| | Co | Ni | Al | Cr | Ti | Nb | Ta | Mo |
|---|---|---|---|---|---|---|---|---|
| BCC | 35.64 ± 0.77 | 26.98 ± 0.62 | 20.10 ± 0.65 | 5.89 ± 0.67 | 3.99 ± 0.23 | 3.36 ± 0.81 | 2.83 ± 0.13 | 1.19 ± 0.35 |
| HCP | 46.85 ± 1.92 | 17.99 ± 1.26 | 3.80 ± 0.54 | 11.69 ± 1.67 | 3.64 ± 0.11 | 8.38 ± 1.12 | 2.63 ± 0.68 | 5.03 ± 0.48 |

Next, an exploration into the origins of the excellent strength-ductility synergy in the as-printed HEA was undertaken. The as-printed NS-ASO HEA exhibited a distinctive two-stage work-hardening behavior, characterized by a significantly higher work-hardening rate and a consistent work-hardening exponent across a wider strain range. The dynamic evolution of the deformation microstructure under varying strains was meticulously characterized using electron backscatter diffraction (EBSD), transmission electron microscopy (TEM), and neutron diffraction. At approximately 5% strain, many dislocations and antiphase boundary (APB) were observed, and the dislocation slipping in the appearance of extended stacking faults (SFs) was activated (FIG. 14A). HAADF-STEM analysis and corresponding selected-area electron diffraction (SAED) patterns revealed that these dislocations and SFs traverse both the NS-ASO and the disordered face-centered cubic (FCC) structures (FIGS. 14B-14C).

Additionally, planar dislocations and stacking faults (SFs) crossing the cell boundary were detected in the initial stage of deformation (FIGS. 15A-15D). As the strain escalated to 22.5%, the dislocations and SFs became the predominant deformation features. Higher stacking faults energy (XX) prevented twinning and phase transformation in the as-printed NS-ASO HEA. Referring to FIG. 14D, an exceptionally high density of SFs on two {111} slip systems and extensive intersections of SFs emerged as the dominant deformation mode. HAADF-STEM further showed the formation of the immobile Lomer-Cottrell (LC) locks, sessile stair-rod dislocations resulting from the interaction of the two leading partial dislocations. Based on these observations, the chemical homogeneous and completely coherent of NS-ASO-disorder structures led to the lower associated elastic interaction between the NS-ASO precipitates and cutting dislocations (FIG. 5A). These structural features facilitated continuous dislocation transmission without altering slip direction, thereby avoiding the accumulation of dislocations and preventing crack nucleation at the interface between the NS-ASO and disordered FCC matrix during deformation. Furthermore, the homogeneous distribution of the NS-ASO structure allowed dislocations and SFs to easily traverse the cell boundary. The SFs even extend up to 100 nm, indicating that the dislocation transmission across the boundaries facilitated long-range dislocation gliding through different NS-ASO and disordered FCC regions, ensuring microscopic homogeneous plastic deformation.

Turning to FIGS. 14E-14H, HAADF-STEM also revealed that the SF interaction generated numerous L-C locks. These L-C locks acted as formidable barriers, effectively pinning the dislocation motion and serving as Frank-Read sources for dislocation multiplication, contributing to the steady and progressive work hardening of the as-printed NS-ASO HEA. Furthermore, the grain subdivision and refinement induced by these dislocation substructures further augmented the strength due to the dynamic Hall-Petch effect. Pre-existing dislocations and paired dislocations were also observed, which formed robust barriers against other mobile dislocations.

Example 3

Preparation of MCoHEA-1

The composition of MCoHEA-1 is as follows: 39-44 at. % cobalt (Co), 28-32 at. % nickel (Ni), 9-12 at. % chromium (Cr), 10-13 at. % aluminum (Al), 0.5-1.5 at. % titanium (Ti), 1.2-2.5 at. % molybdenum (Mo), 1.3-2.2 at. % tantalum (Ta), and 0.8-1.2 at. % niobium (Nb).

MCoHEA-1 was prepared as follows:

(1) weighting and blending designated elemental metal powders of Co, Ni, Cr, Al, Ti, Mo, Ta, and Nb to obtain a mixture.

(2) degassing and slagging the mixture to reach a composition.

(3) forming an alloy liquid in a vacuum induction furnace and casting the liquid into an alloy ingot.

(4) processing the obtained alloy ingot into spherical alloy powder using plasma rotation click atomization technology occurs at a working speed of 40,000 rpm to 50,000 rpm and a working pressure of 6 MPa to 10 MPa.

(5) melting and solidifying the spherical alloy powder by selective laser to produce a multi-component high entropy alloy with high-density nanoscale atomic self-ordering structure, which has high density and excellent strong plastic energy.

The morphology evaluation was conducted by SEM. FIG. 16A shows the SEM image of MCoHEA-1, which has a particle size distribution between 20-65 μm, and its average particle size is in a range of 28-37 μm.

FIG. 17 presents the XRD pattern of the as-built MCoHEA sample. The x-axis of the XRD pattern corresponds to the diffraction angle, typically represented as 2θ. This angle is measured in degrees and represents the angle between the incident X-ray beam and the scattered X-rays. The y-axis of the XRD pattern corresponds to the intensity of the diffracted X-rays. The term "FCC" refers to a face-centered cubic crystal structure. FCC is one of the three common crystal structures found in metals, along with body-centered cubic (BCC) and hexagonal close-packed (HCP) structures. The diffraction angles (2θ) at which the peaks occur in the pattern are as follows: 43.53°, 50.52°, 74.55°, 90.35°, and 95.70°. The peak at 50.52° has the highest relative intensity.

The sphericity of the powder is more than 95% when laser melting is performed using the following parameters: laser power of 315 W, scanning speed of 750 mm/s, scanning thickness of 40 μm, and input energy density of 95.45 J/mm$^3$. these particles are roughly round in shape, like a ball. They may have a smooth surface or be covered in small protrusions.

In one embodiment, the particle shape is not limited to spherical.

The density, tensile strength and uniform elongation of the MCoHEA-1 were also tested. The printed MCoHEA-1 has a density of 95.5%, a tensile strength of 1.36 GPa, and a uniform elongation of 15.1%.

Example 4

Preparation of MCoHEA-2

The composition of MCoHEA-2 is as follows: 38-43 at. % cobalt (Co), 26-29 at. % nickel (Ni), 8-11 at. % chromium (Cr), 8-12 at. % aluminum (Al), 1.2-2.1 at. % titanium (Ti), 1.6-2.6 at. % molybdenum (Mo), 1.5-2.1 at. % tantalum (Ta), and 1.1-2.1 at. % niobium (Nb).

The preparation method of MCoHEA-2 is the same as that of MCoHEA-1, the only difference is that the atomic percentages used are different.

The morphology evaluation was conducted by SEM. FIG. 16B shows the SEM image of MCoHEA-2, which has a particle size distribution between 20-65 μm, and its average particle size is in a range of 28-37 μm.

The sphericity of the powder is more than 95% when laser melting is performed using the following parameters: laser power of 270 W, scanning speed of 950 mm/s, scanning thickness of 40 μm, and input energy density of 64.59 J/mm$^3$. These particles are roughly round in shape, like a ball. They may have a smooth surface or be covered in small protrusions.

The density, tensile strength and uniform elongation of the MCoHEA-2 were also tested. The printed MCoHEA-2 has a density of 99.997%, an ultimate tensile strength (UTS) of 1.50 GPa, and a yield strength (YS) of 970 MPa. Also, FIG. 18 shows that the printed MCoHEA-2 exhibits uniform elongation of about 22.5%.

In one embodiment, the as-built sample was subjected to aging heat treatment (1050° C. for 30 minutes plus 800° C. for 4 hours, AC) in ambient temperature. After heating, the microstructure morphology changed from FIGS. 19A-19B. The uniform elongation was measured to be about 32.1%, as shown in FIG. 20.

Example 5

Preparation of MCoHEA-3

The composition of MCoHEA-3 is as follows: 38-43 at. % cobalt (Co), 26-29 at. % nickel (Ni), 8-11 at. % chromium (Cr), 8-12 at. % aluminum (Al), 1.2-2.1 at. % titanium (Ti), 1.6-2.6 at. % molybdenum (Mo), 1.5-2.1 at. % tantalum (Ta), and 1.1-2.1 at. % niobium (Nb).

The preparation method of MCoHEA-3 is the same as that of MCoHEA-1, the only difference is that the atomic percentages used are different.

The morphology evaluation was conducted by SEM. FIG. 16C shows the SEM image of MCoHEA-3, which has a particle size distribution between 20 μm and 65 μm, and its average particle size is in a range of 28 to 37 μm.

The sphericity of the powder is more than 95% when laser melting is performed using the following parameters: laser power of 270 W, scanning speed of 950 mm/s, scanning thickness of 40 μm, and input energy density of 64.59 J/mm. these particles are roughly round in shape, like a ball. They may have a smooth surface or be covered in small protrusions.

The as-built sample was subjected to aging heat treatment (800° C. for 4 h, AC) in ambient temperature. The uniform elongation was measured to be about 11.8%, as shown in FIG. 21. The density, ultimate tensile strength (UTS), uniform elongation and yield strength (YS) of the MCoHEA-3 were also tested. The printed MCoHEA-3 has a density of 99.997%, an UTS of 1.36 GPa, and a YS of 980 MPa.

Micro-CT analysis, or micro computed tomography analysis, is a non-destructive imaging technique that uses X-rays to create high-resolution, three-dimensional images of small objects or samples. During micro-CT analysis, the sample is placed inside the scanner, which rotates and takes a series of X-ray images from different angles. These images are then reconstructed into a 3D image using computer algorithms. The histogram displays the distribution of data based on the EqDiameter variable, with the relative frequency of each data point being represented by the height of the bars. Referring to FIGS. 22A-22B, the tallest bar is at an EqDiameter value of about 0.5 μm, indicating pores with an EqDiameter of about 0.5 μm are the most frequently occurring size.

INDUSTRIAL APPLICABILITY

Multi-principal element high entropy alloys are expected to have a wide range of potential applications in aerospace, automotive, nuclear engineering and other fields. The multi-component high entropy alloy of the present invention fabricated through selective laser melting offers enhanced safety, affordability, and reduced processing time, thus presenting significant competitiveness within the market. This nanoscale atomic self-ordering strategy provides a new pathway to design ultrastrong-yet-ductile alloys with near-zero void, which can also be feasibly applied to many other alloy systems like superalloys, steels, and aluminum alloys for extensive engineering applications.

The foregoing description of the present invention has been provided for the purposes of illustration and description. It is not intended to be exhaustive or to limit the invention to the precise forms disclosed. Many modifications and variations will be apparent to the practitioner skilled in the art.

The embodiments were chosen and described in order to best explain the principles of the invention and its practical application, thereby enabling others skilled in the art to understand the invention for various embodiments and with various modifications that are suited to the particular use contemplated.

Definition

The term "at. %" used herein refers to atomic percent. For example, if a sample contains 80 atoms of element A and 20 atoms of element B, the atomic percent of element A would be 80 at. %, and the atomic percent of element B would be 20 at. %.

The term "multi-component alloy" used herein is a type of alloy that is composed of three or more different elements in varying proportions. Multi-component alloys can include binary, ternary, quaternary, and even higher-order combinations of elements.

The term "relative density", also known as specific gravity, is the ratio of the density of a material to the density of a reference material under specified conditions. It is typically expressed as a percentage. A relative density of 100% indicates that the material has the same density as the reference material under the given conditions. If the relative density is greater than 100%, it means the material is denser than the reference material, and if it is less than 100%, it means the material is less dense than the reference material.

The term "near-void-free" refers to the condition in which a material contains almost no pores or voids. In metallic materials, pores or voids are typically considered undesirable defects as they can lead to degradation in mechanical properties such as strength and toughness. Therefore, "near-void-free" indicates that the number of pores present in the material is very minimal, approaching zero or zero, ensuring that the material maintains high quality and reliability.

Throughout this specification, unless the context requires otherwise, the word "comprise" or variations such as "comprises" or "comprising", will be understood to imply the inclusion of a stated integer or group of integers but not the exclusion of any other integer or group of integers. It is also noted that in this disclosure and particularly in the claims and/or paragraphs, terms such as "comprises", "comprised", "comprising" and the like can have the meaning attributed to it in U.S. Patent law; e.g., they allow for elements not explicitly recited, but exclude elements that are found in the prior art or that affect a basic or novel characteristic of the present invention.

Furthermore, throughout the specification and claims, unless the context requires otherwise, the word "include" or variations such as "includes" or "including", will be understood to imply the inclusion of a stated integer or group of integers but not the exclusion of any other integer or group of integers.

As used herein and not otherwise defined, the terms "substantially," "substantial," "approximately" and "about" are used to describe and account for small variations. When used in conjunction with an event or circumstance, the terms can encompass instances in which the event or circumstance occurs precisely as well as instances in which the event or circumstance occurs to a close approximation. For example, when used in conjunction with a numerical value, the terms can encompass a range of variation of less than or equal to +10% of that numerical value, such as less than or equal to +5%, less than or equal to +4%, less than or equal to +3%, less than or equal to +2%, less than or equal to +1%, less than or equal to +0.5%, less than or equal to +0.1%, or less than or equal to +0.05%.

References in the specification to "one embodiment", "an embodiment", "an example embodiment", etc., indicate that the embodiment described can include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

In the methods of preparation described herein, the steps can be carried out in any order without departing from the principles of the invention, except when a temporal or operational sequence is explicitly recited. Recitation in a claim to the effect that first a step is performed, and then several other steps are subsequently performed, shall be taken to mean that the first step is performed before any of the other steps, but the other steps can be performed in any suitable sequence, unless a sequence is further recited within the other steps. For example, claim elements that recite "Step A, Step B, Step C, Step D, and Step E" shall be construed to mean step A is carried out first, step E is carried out last, and steps B, C, and D can be carried out in any sequence between steps A and E, and that the sequence still falls within the literal scope of the claimed process. A given step or sub-set of steps can also be repeated. Furthermore, specified steps can be carried out concurrently unless explicit claim language recites that they be carried out separately.

Other definitions for selected terms used herein may be found within the detailed description of the present invention and apply throughout. Unless otherwise defined, all other technical terms used herein have the same meaning as commonly understood to one of ordinary skill in the art to which the present invention belongs.

What is claimed is:

1. A multi-component high entropy alloy with nanoscale atomic self-ordering structure, comprising a composition of cobalt (Co), nickel (Ni), chromium (Cr), aluminum (Al), titanium (Ti), molybdenum (Mo), tantalum (Ta), and niobium (Nb), wherein the multi-component high entropy alloy is represented by the formula: $Co_aNi_bCr_cAl_dTi_eMo_fTa_gNb_h$, where a, b, c, d, e, f, g, h, correspond to the atomic percentage of metal elements and, $10 \le a \le 70$, $10 \le b \le 50$, $0.1 \le c \le 20$, $0.1 \le d \le 20$, $0.01 \le e \le 10$, $0.01 \le f \le 10$, $0.1 \le g \le 10$, $0.01 \le h \le 10$, and wherein the multi-component high entropy alloy is a near-void-free alloy, and the multi-component high entropy alloy exhibits the nanoscale atomic self-ordering structure with dimensions ranging from 1 to 5 nm, wherein the multi-component high entropy alloy has a relative density of at least 95% compared to a reference material;

wherein the alloy is prepared by the following steps:

weighting and blending metal powders to obtain a mixture;

degassing and slagging the mixture to obtain a composition;

forming an alloy liquid in a vacuum induction furnace and casting the liquid into an alloy ingot;

processing the alloy ingot into spherical alloy powder; and melting and solidifying the spherical alloy powder by selective laser to obtain the multi-component high entropy alloy.

2. The multi-component high entropy alloy of claim 1, wherein the composition comprises 30-50 at. % cobalt (Co), 20-40 at. % Ni, 1-15 at. % Cr, 1-15 at. % Al, 0.1-5.0 at. % Ti, 0.5-5 at. % Mo, 0.5-5 at. % Ta, and 0.1-5 at. % Nb.

3. The multi-component high entropy alloy of claim 1, wherein the composition comprises 36-45 at. % Co, 26-32 at. % Ni, 7-12 at. % Cr, 8-13 at. % Al, 0.5-3 at. % Ti, 0.6-2.5 at. % Mo, 0.7-2.6 at. % Ta, and 0.7-2.2 at. % Nb.

4. The multi-component high entropy alloy of claim 1, wherein the multi-component high entropy alloy has diffraction angles (2θ) at which the peaks occur in the X-ray diffraction (XRD) pattern as follows: 43.53°, 50.52°, 74.55°, 90.35°, and 95.70°.

5. The multi-component high entropy alloy of claim 1, wherein the multi-component high entropy alloy has a size distribution ranging from 10 μm to 100 μm.

6. The multi-component high entropy alloy of claim 1, wherein the multi-component high entropy alloy has an ultimate tensile strength of at least 1 GPa.

7. The multi-component high entropy alloy of claim 1, wherein the multi-component high entropy alloy has a uniform elongation of at least 15.0% under tension at ambient temperature.

8. The multi-component high entropy alloy of claim 1, wherein the multi-component high entropy alloy has a sphericity of at least 90%.

9. The multi-component high entropy alloy of claim 1, wherein the metal powders comprise 10-70 at. % cobalt (Co), 10-50 at. % Ni, 0.1-20 at. % Cr, 0.1-20 at. % Al, 0.01-10 at. % Ti, 0.01-10 at. % Mo, 0.1-10 at. % Ta, and 0.01-10 at. % Nb.

10. The multi-component high entropy alloy of claim 1, wherein the metal powders comprise 30-50 at. % cobalt (Co), 20-40 at. % Ni, 1-15 at. % Cr, 1-15 at. % Al, 0.1-5.0 at. % Ti, 0.5-5 at. % Mo, 0.5-5 at. % Ta, and 0.1-5 at. % Nb.

11. The multi-component high entropy alloy of claim 1, wherein step of degassing and slagging the mixture to obtain a composition occurs in an inert atmosphere and is conducted at a working temperature in a range of 1500° C. to 1600° C.

12. The multi-component high entropy alloy of claim 1, wherein step of degassing and slagging the mixture to obtain a composition is conducted for 5-10 minutes.

13. The multi-component high entropy alloy of claim 1, wherein the temperature within the vacuum induction furnace is controlled at 1400° C. to 1450° C.

14. The multi-component high entropy alloy of claim 1, wherein step of processing the alloy ingot into spherical alloy powder is carried out using plasma rotation click atomization, and the step occurs at a working speed of 40,000 rpm to 50,000 rpm and a working pressure of 6 MPa to 10 MPa.

15. The multi-component high entropy alloy of claim 1, wherein the multi-component high entropy alloy has a size distribution ranging from 10 μm to 100 μm.

16. The multi-component high entropy alloy of claim 1, wherein the multi-component high entropy alloy has a sphericity of at least 90%.

* * * * *